US006843003B2

(12) United States Patent
Araoka

(10) Patent No.: US 6,843,003 B2
(45) Date of Patent: Jan. 18, 2005

(54) GRAVEL-LIKE MATERIAL REMOVING DEVICE

(75) Inventor: Toshinobu Araoka, Kitakyushu (JP)

(73) Assignee: Toyo Denki Industrial Co., Ltd., Fukuoka (JP)

( * ) Notice: Subject to any disclaimer, the term of this patent is extended or adjusted under 35 U.S.C. 154(b) by 84 days.

(21) Appl. No.: 09/991,871

(22) Filed: Nov. 26, 2001

(65) Prior Publication Data

US 2003/0000113 A1 Jan. 2, 2003

(30) Foreign Application Priority Data

Jun. 29, 2001 (JP) ..... 2001/199806

(51) Int. Cl.[7] ..... E02F 3/92
(52) U.S. Cl. ..... 37/317
(58) Field of Search ..... 37/320, 317, 318, 37/321, 322, 323, 324; 431/18–22, 38, 39, 42, 60–66, 75–90, 356; 415/121.2, 58.4, 58.6, 55.1

(56) References Cited

U.S. PATENT DOCUMENTS 4,305,214 A * 12/1981 Hurst ..... 37/331
4,322,898 A * 4/1982 Bos ..... 37/326
4,409,746 A * 10/1983 Beck ..... 37/317
4,456,424 A * 6/1984 Araoka ..... 415/121.2
4,596,511 A * 6/1986 Weinrib ..... 415/58.4
4,728,256 A * 3/1988 Araoka ..... 415/121.2
4,776,753 A * 10/1988 Weinrib ..... 415/55.1
4,792,275 A * 12/1988 Weinrib ..... 415/58.6
4,914,841 A * 4/1990 Weinrib ..... 37/195
5,005,364 A * 4/1991 Nelson ..... 62/76
5,238,363 A * 8/1993 Thielke et al. ..... 415/121.2
5,893,703 A * 4/1999 Weinrib ..... 415/110
6,406,635 B1 * 6/2002 Smith et al. ..... 210/805

FOREIGN PATENT DOCUMENTS

JP 53-30652 3/1979

* cited by examiner

*Primary Examiner*—Robert E Pezzuto
(74) *Attorney, Agent, or Firm*—Browdy and Neimark, P.L.L.C.

(57) ABSTRACT

The gravel-or-the-like removing device includes an impeller casing which accommodates an impeller driven by a motor in the inside thereof and has a suction opening at the center of the lower surface, a peripheral wall for preventing collapse and inflow of gravel or the like which is constituted of a cylindrical body which has an upper end thereof connected to a lower portion of the impeller casing and a lower end thereof opened downwardly and forms a water-retention space in the inside thereof, and a water suction pipe which has an upper-end opening thereof opened in water above a gravel-or-the-like piled level and a lower opening thereof communicably connected with the water retention space.

17 Claims, 11 Drawing Sheets

GRAVEL-LIKE MATERIAL REMOVING DEVICE

BACKGROUND OF THE INVENTION (1) Field of the Invention

The present invention relates to a gravel-or-the-like removing device which can discharge gravel, sand, mud or the like in a dredging site, a civil engineering work site, a sewage treatment plant, a sedimentation pool or a pit within a plant, an inside of a manhole or the like to a given place. In this specification, the term "gravel-or-the-like" means not only gravel but also sand, gravel, mud and the like.

(2) Description of the Related Art

Conventionally, as a gravel-or-the-like removing device which is served for the above-mentioned usage, there exists a suction pump 150 which has a constitution shown in FIG. 15, for example. This suction pump 150 is substantially comprised of an impeller casing 154 which accommodates an impeller 152 driven by a motor 151 in the inside thereof and includes a suction opening 153 at the center of a lower surface thereof, a perforated cylindrical strainer 155 which has an upper end thereof connected to a lower portion of an impeller casing 154 and a lower end thereof opened downwardly, and an agitator 157 which is mounted on an agitator mounting shaft 156 which is connected to an output shaft of the motor 151.

To explain the gravel or the like removing operation using such a suction pump 150, the impeller 152 and the agitator 157 are integrally rotated upon driving of the motor 151 so that gravel or the like is agitated by the agitator 157, the agitated gravel or the like is sucked into the inside of the impeller casing 154 by the impeller 152, and thereafter, the agitated gravel or the like is discharged to a desired location through a discharge pipe 158.

In the normal operation, at the time of starting the suction pump 150, as a piled level of the gravel or the like S, a level D which is positioned below the cylindrical strainer 155 is assumed. However, there may be a case that the operation of the suction pump 150 is temporarily stopped. In this case, there is a possibility that the gravel-or-the-like piled level exceeds the level D, that is, the gravel-or-the-like piled level reaches a level E.

In such a case, the gravel or the like is filled in the inside of the cylindrical strainer 155 through lateral holes formed in a peripheral wall of the cylindrical strainer 155. On the other hand, since water which gives fluidity to the gravel or the like is not supplied from the outside, the gravel-or-the like suction and discharge operation becomes difficult.

To solve such problems, Japanese Laid-open Patent Publication 30652/1970 proposes a gravel-or-the-like removing device 160 which has a constitution shown in FIG. 16 and FIG. 17.

As shown in the drawing, the gravel-or-the-like removing device 160 is mounted on a bottom surface 161 of a pit A on which the gravel or the like is piled. A suction pump 162 which constitutes a body portion of the gravel-or-the-like removing device 160 includes an impeller casing 164 which forms a gravel-or-the-like suction opening at the center of a lower end thereof and makes a gravel-or-the-like discharge opening formed in a portion of a peripheral wall thereof communicably connected to a discharge pipe 163, an impeller 165 which is rotatably accommodated in the inside of the impeller casing 164, and a watertight motor 166 which rotatably drives the impeller 165. A cylindrical strainer portion 168 which has a bottom plate 167 is connected to a bottom portion of the impeller casing 164 in a coaxial manner. A large number of lateral holes 170 and vertical holes 171 are respectively formed in an entire peripheral wall 169 and the entire bottom plate 167 of the cylindrical strainer portion 168. The cylindrical strainer portion 168 having such a constitution is supported on a pump support base 172 which is formed of an annular frame. Further, an agitator 174 is fixedly secured to an agitator mounting shaft 173 which is integrally connected to an output shaft of the watertight motor 166.

Further, a water suction pipe 175 which is vertically arranged in the inside of the pit A has a lower-end opening 176 thereof communicably connected to a portion of the peripheral wall 169 of the cylindrical strainer portion 168 and an upper-end opening 177 thereof provided with a water auction auxiliary strainer 178. Here, as shown in FIG. 17, the lower-end opening 176 of the water suction pipe 175 is communicated with the cylindrical strainer portion 168 at a position below the gravel-or-the-like piled level B. On the other hand, the water suction auxiliary strainer 178 is disposed far above the gravel-or-the-like piled level B and is positioned in the vicinity of a filled water level C.

Due to such a constitution, even when the suction pump is embedded in the gravel or the like, at the time of starting the suction pipe, it becomes possible to supply water outside a gravel-or-the-like piled region which is disposed above the gravel-or-the-like piled level B into the suction pump through the suction pipe so that the gravel or the like can be diluted whereby the gravel or the like suction and discharge operation can be performed smoothly.

However, the above-mentioned gravel-or-the-like removing device 160 has a following task to be solved in an actual operation. That is, as shown in FIG. 16 and FIG. 17, the cylindrical strainer portion 168 has a large number of lateral holes 170 on the entire surface of the peripheral wall 169. Accordingly, when the cylindrical strainer portion 168 is completely embedded in the inside of the gravel or the like during a period in which the operation of the suction pump is stopped, a large volume of gravel or the like which is present along the outer periphery of the peripheral wall 169 is collapsed and enters the inside of the cylindrical strainer portion 168 through these lateral holes 170 so as to fill the inside space of the cylindrical strainer portion 168 with the gravel or the like. When the suction pump is started in such a state, although water is supplied to the inside of the cylindrical strainer portion 168 through the suction pipe 175, a quantity of the gravel or the like which the suction pump intends to suck becomes overwhelmingly large compared to a quantity of water supplied through the suction pipe 175. Accordingly, the concentration of the gravel or the like is still excessively high so that the smooth suction and discharge operation becomes difficult.

The present invention has been made to solve such a problem and it is an object of the present invention to provide a gravel-or-the-like removing device which can surely and efficiently suck and discharge the gravel or the like even when the suction pump is embedded in the inside of the gravel or the like as in the case that the operation of the suction pump is temporarily stopped.

SUMMARY OF THE INVENTION

According to a first aspect of the present invention to achieve the above-mentioned object, there is provided a gravel-or-the-like removing device which includes an impeller casing which accommodates an impeller driven by a motor in the inside thereof and has a suction opening at the center of the lower surface thereof, a peripheral wall for preventing collapse and inflow of gravel or the like which is constituted of a cylindrical body which has an upper end thereof connected to a lower portion of the impeller casing and a lower end thereof opened downwardly and forms a water retention space in the inside thereof, and a water suction pipe which has an upper-end opening thereof opened in water above a gravel-or-the-like piled level and a lower-end opening thereof communicably connected with the water retention space.

By providing such a constitution to the gravel-or-the-like removing device, when the gravel-or-the-like piled level is elevated during the period in which the operation of the suction pump which constitutes an example of the gravel-or-the-like removing device is stopped, for example, and the impeller casing is embedded in the gravel or the like, the inflow of the gravel or the like into the inner space of the peripheral wall for preventing collapse and inflow of the gravel or the like can be surely prevented so that the water retention space which is filled with water can be ensured. On the other hand, the water suction pipe is communicably connected to this water retention space. Accordingly, when the suction pump is driven, since the fluidity of the water is higher than the fluidity of the gravel or the like which intrudes into the lower portion of the suction pump, a large quantity of water is supplied into the water retention space by suction so that the gravel or the like can be diluted with this water and is surely and effectively sucked and discharged.

Further, the present invention is also characterized by following constitutions.

The peripheral wall for preventing collapse and inflow of gravel or the like has a whole area of a lower-end opening thereof opened. That is, so long as the collapse and inflow of the gravel or the like which may take through lateral holes formed on the peripheral wall can be prevented, even when the lower-end opening of the peripheral wall for preventing collapse and inflow of the gravel or the like is opened in its entirety, the inflow of the gravel or the like from below the peripheral wall for preventing collapse and inflow of gravel or the like can be suppressed as much as possible so that the sufficiently wide water retention space can be ensured in the inside of the peripheral wall for preventing collapse and inflow of gravel or the like. In this case, since a perforated bottom plate which constitutes a so-called resisting body is not present, by continuing the operation after starting the suction pump, the gravel or the like can be sucked and discharged more smoothly and efficiently while diluting the gravel or the like with water. On the other hand, depending on the property of the gravel or the like, a bottom plate may be mounted on the lower-end opening of the peripheral wall for preventing collapse and inflow of gravel or the like and a plurality of gravel-or-the-like inflow openings may be formed in this bottom plate.

It is preferable that the peripheral wall for preventing collapse and inflow of gravel or the like has no lateral holes on the entire peripheral surface thereof from a viewpoint of completely preventing the collapse and the suction of the gravel or the like which is present along the outer peripheral surface of the peripheral wall for preventing collapse and inflow of gravel or the like into the water retention space. On the other hand, depending of the property of the gravel or the like, to increase the mixing ratio of water into the gravel or the like, it may be possible to partially form lateral holes in the peripheral wall for preventing collapse and inflow of gravel or the like to an extent that the collapse and the inflow of the gravel or the like into the water retention space can be prevented.

An output shaft of the motor is extended downwardly after passing through the suction opening of the impeller casing and the peripheral wall for preventing collapse and inflow of gravel or the like and an agitator is fixedly secured to an extended end of the output shaft. In this case, the agitator agitates the gravel or the like and mix the agitated gravel or the like and water so as to enhance the fluidity of the gravel or the like, and thereafter, the gravel or the like is sucked and discharged using the suction pump, whereby the suction and discharge effect can be further enhanced.

Further, it may be possible to mount a flat plate for preventing winding of string-like material to a lower surface of the impeller casing at the water retention space side or to mount a cylinder for preventing winding of string-like material on an outer peripheral surface of the agitator mounting shaft. In this case, even when the string-like material is mixed into the gravel or the like, it becomes possible to prevent the string-like material from being wound around a lower surface of the impeller casing and the agitator mounting shaft as much as possible so that the gravel or the like which contains the string-like material can be smoothly sucked and discharged.

According to a second aspect of the present invention to achieve the above-mentioned object, there is provided a gravel-or-the-like removing device which includes an impeller casing which accommodates an impeller driven by a motor in the inside thereof and has a suction opening at the center of the lower surface, a cylindrical strainer which has an upper end thereof connected to a lower portion of the impeller casing and a lower end thereof opened downwardly, and a peripheral wall for preventing collapse and inflow of gravel or the like which is constituted of a cylindrical body arranged around the cylindrical strainer, makes an upper end of the cylindrical body connected to a lower portion of the impeller casing and a lower end thereof reach a position substantially equal to a lower end surface of the cylindrical strainer and forms a water retention space including the inside of the cylindrical strainer therein, and a water suction pipe which has an upper-end opening thereof opened in water above a gravel-or-the-like piled level and a lower-end opening thereof communicably connected to the water retention space.

By providing such a constitution to the gravel-or-the-like removing device, in the same manner as the gravel-or-the-like removing device according to the first aspect of the present invention, the inflow of the gravel or the like into the inner space of, the peripheral wall for preventing collapse and inflow of gravel or the like can be surely prevented so that the water retention space filled with water can be ensured. Accordingly, by diluting the gravel or the like with water supplied through the water suction pipe, the reliable and efficient suction and discharge can be realized.

Further, according to the present invention, in an existing gravel-or-the-like removing device, by merely mounting a peripheral wall for preventing collapse and inflow of gravel or the like around the cylindrical strainer (that is, without performing a large remodeling of the existing gravel-or-the-like removing device), the above-mentioned reliable and efficient suction and discharge of the gravel or the like can be realized.

Further, the second aspect of the present invention is characterized by providing following constitutions to the above-mentioned gravel-or-the-like removing device.

That is, in the same manner as the first aspect of the invention, it is preferable that the peripheral wall for preventing collapse and inflow of gravel or the like has no holes over the entire peripheral surface thereof from the viewpoint of completely preventing the collapse and the suction of the gravel or the like present along the outer peripheral surface of the peripheral wall for preventing collapse and inflow of gravel or the like into the water retention space. On the other hand, depending on the property of the gravel or the like, to increase the water mixing ratio, the peripheral wall for preventing collapse and inflow of gravel or the like may be partially provided with holes on the condition that such holes do not generate the collapse and the inflow of the gravel or the like into the water retention space.

Further, an output shaft of the motor is extended downwardly through the suction opening of the impeller casing and the cylindrical strainer and an agitator is fixedly secured to an extended end. In this case, since the gravel or the like can be sucked and discharged by the suction pump after enhancing the fluidity of the gravel or the like by agitating the gravel or the like by the agitator and mixing the agitated gravel or the like with water, the suction and discharge effect can be further enhanced.

The communicable communication of the lower-end opening of the water suction pipe to the water retention space is performed by communicably connecting the lower-end opening of the water suction pipe to the water suction opening formed in the peripheral wall for preventing collapse and inflow of gravel or the like. On the other hand, it may be possible to make the lower-end opening of the water suction pipe penetrate the peripheral wall for preventing collapse and inflow of gravel or the like and thereafter make the lower-end opening communicably connected with a water suction opening formed in the cylindrical strainer. In the latter case, since the lower-end opening of the water suction pipe can be directly communicably connected with the water retention space in the inside of the cylindrical strainer, even when the gravel or the like flows into the inside of the water retention space defined between the cylindrical strainer and the peripheral wall for preventing collapse and inflow of gravel or the like, so long as the water retention space is ensured in the inside of the cylindrical strainer, the suction and discharge of the gravel or the like can be performed surely and efficiently.

Further, a plurality of water suction pipes may be provided and the lower-end openings of one or more water suction pipes may be communicably connected with water suction openings formed in the peripheral wall for preventing collapse and inflow of gravel or the like and the lower-end openings of remaining one or more water suction pipes may be made to penetrate the peripheral wall for preventing collapse and inflow of gravel or the like and may be communicably connected with the water suction openings formed in the cylindrical strainer. In this case, since water can be supplied to both of the water retention space defined between the cylindrical strainer and the peripheral wall for preventing collapse and inflow of gravel or the like and the water retention space defined in the inside of the cylindrical strainer, the gravel or the like can be diluted more efficiently so that the suction and discharge of the gravel or the like can be performed reliably and efficiently. Here, the cylindrical strainer may be formed of not only a perforated peripheral wall but also a non-perforated peripheral wall. In this case, effects for preventing the collapse and the inflow of the gravel or the like can be performed twice and the water retention space can be surely formed at least in the inside of the cylindrical strainer.

According to a third aspect of the present invention to achieve the above-mentioned object, there is provided, a gravel-or-the-like removing device which includes an impeller casing which accommodates an impeller driven by a motor in the inside thereof and has a suction opening at the center of the lower surface, a cylindrical strainer which has an upper end thereof connected to a lower portion of the impeller casing and a lower end thereof opened downwardly, and a cover for preventing collapse and inflow of gravel or the like which is constituted of a bowl-shaped body opened downwardly and arranged around the impeller casing and the strainer, makes an upper end of the bowl-shaped body connected to a motor casing which is mounted on the impeller casing and a lower end of the bowl-shaped body reach a position substantially equal to a lower end surface of the cylindrical strainer and forms a water retention space including the inside of the cylindrical strainer therein, and a water suction pipe which has an upper-end opening thereof opened in water above a gravel-or-the-like piled level and the lower-end opening thereof communicably connected to the water retention space.

By providing such a constitution to the gravel-or-the-like removing device, in the same manner as the gravel-or-the-like removing devices according to the first and second aspects of the present invention, the inflow of the gravel or the like into the inner space of the cover for preventing collapse and inflow of gravel or the like can be surely prevented so that the water retention space filled with water can be ensured. Accordingly, by diluting the gravel or the like with water supplied through the water suction pipe, the reliable and efficient suction and discharge of the gravel or the like can be realized. Further, according to this aspect of the present invention, since the cover for preventing collapse and inflow of gravel or the like is configured to surround not only the cylindrical strainer but also the impeller casing, the wider water retention space can be formed at the lower portion of the gravel-or-the-like removing device, whereby the gravel or the like is diluted with water supplied through the water suction pipe thus enabling the more reliable and efficient suction and discharge of the gravel or the like.

According to a fourth aspect of the present invention to achieve the above-mentioned object, there is provided a gravel-or-the-like removing device which includes an impeller casing which accommodates an impeller driven by a motor in the inside thereof and has a suction opening at the center of the lower surface thereof, a cylindrical strainer which has an upper end thereof connected to a lower portion of the impeller casing and a lower end thereof opened downwardly, and a cover for preventing collapse and inflow of gravel or the like which is constituted of a bowl-shaped body opened downwardly and arranged to surround the whole gravel-or-the-like removing device including the impeller casing and the strainer and makes a lower end of the bowl-shaped body reach a position substantially equal to a lower end surface of the cylindrical strainer and forms a water retention space including the inside of the cylindrical strainer therein, and a water suction pipe which has an upper-end opening thereof opened in water above a gravel-or-the-like piled level and the lower-end opening thereof communicably connected to the water retention space.

By providing such a constitution to the gravel-or-the-like removing device, in the same manner as the gravel-or-the-like removing devices according to the first to third aspects of the present invention, the inflow of the gravel or the like into the inner space of the cover for preventing collapse and inflow of gravel or the like can be surely prevented so that the water retention space filled with water can be ensured. Accordingly, by diluting the gravel or the like with water supplied through the water suction pipe, the reliable and efficient suction and discharge of the gravel or the like can be realized. Further, according to this aspect of the present invention, since the cover for preventing collapse and inflow of gravel or the like is configured to surround not only the cylindrical strainer but also the whole gravel-or-the-like removing device, the wider water retention space can be formed around the gravel-or-the-like removing device, whereby the gravel or the like is diluted with water supplied through the water suction pipe thus enabling the more reliable and efficient suction and discharge of the gravel or the like.

According to a fifth aspect of the present invention to achieve the above-mentioned object, there is provided a gravel-or-the-like removing device which includes an impeller casing which accommodates an impeller driven by a motor in the inside thereof and has a suction opening at the center of the lower surface, a cylindrical strainer which has an upper end thereof connected to a lower portion of the impeller casing and a lower end thereof opened downwardly, a plurality of rotary digging cutters which are driven by motors, and a peripheral wall for preventing collapse and inflow of gravel or the like which is constituted of a cylindrical body being arranged around the cylindrical strainer and having a cross section in a plan view sufficiently wide to cover the rotary digging cutters together with the cylindrical strainer from above and makes an upper end thereof contiguously connected to a lower portion of the impeller casing and a lower end thereof reach a position substantially equal to a lower end surface of the cylindrical strainer and forms a water retention space including the inside of the cylindrical strainer therein, and a water suction pipe which has an upper-end opening thereof opened in water above a gravel-or-the-like piled level and a lower-end opening thereof communicably connected to the water retention space.

By providing such a constitution to the gravel-or-the-like removing device, in the same manner as the gravel-or-the-like removing devices according to the first to fourth aspects of the present invention, the inflow of the gravel or the like into the inner space of the peripheral wall for preventing collapse and inflow of gravel or the like can be surely prevented so that the water retention space filled with water can be ensured. Accordingly, by diluting the gravel or the like with water supplied through the water suction pipe, the reliable and efficient suction and discharge of the gravel or the like can be realized. Further, according to this aspect of the present invention, the peripheral wall for preventing collapse and inflow of gravel or the like is arranged around the cylindrical strainer and has a cross section in a plan view sufficiently wide to cover the rotary digging cutters together with the cylindrical strainer from above and hence, the wider water retention space can be formed at the lower portion of the gravel-or-the-like removing device whereby the gravel or the like dug by the digging cutters can be reliably and efficiently sucked and discharged by diluting the gravel or the like with water supplied through the water suction pipe.

According to a sixth aspect of the present invention to achieve the above-mentioned object, there is provided a gravel-or-the-like removing device which includes an impeller casing which accommodates an impeller driven by a motor in the inside thereof and has a suction opening at the center of the lower surface, a cylindrical strainer which has an upper end thereof connected to a lower portion of the impeller casing and a lower end thereof opened downwardly, a plurality of jet nozzles which are arranged around the cylindrical strainer circumferentially and eject jet water downwardly upon actuation of a jet water supply pump, and a peripheral wall for preventing collapse and inflow of gravel or the like which is constituted of a cylindrical body being arranged around the cylindrical strainer and having a cross section in a plan view sufficiently wide to cover the jet nozzles together with the cylindrical strainer from above and makes an upper end thereof contiguously connected to a lower portion of the impeller casing and a lower end thereof reach a position substantially equal to a lower end surface of the cylindrical strainer and forms a water retention space including the inside of the cylindrical strainer therein, and a water suction pipe which has an upper-end opening thereof opened in water above a gravel-or-the-like piled level and a lower-end opening thereof communicably connected to the water retention space.

By providing such a constitution to the gravel-or-the-like removing device, in the same manner as the gravel-or-the-like removing devices according to the first to fifth aspects of the present invention, the inflow of the gravel or the like into the inner space of the peripheral wall for preventing collapse and inflow of gravel or the like can be surely prevented so that the water retention space filled with water can be ensured. Accordingly, by diluting the gravel or the like with water supplied through the water suction pipe, the reliable and efficient suction and discharge of the gravel or the like can be realized. Further, according to this aspect of the present invention, the peripheral wall for preventing collapse and inflow of gravel or the like which is constituted of a cylindrical body which is arranged around the cylindrical strainer and has a cross section in a plan view sufficiently wide to cover the jet nozzles together with the cylindrical strainer from above and hence, the wider water retention space can be formed at the lower portion of the gravel-or-the-like removing device whereby the gravel or the like dug by the jet water ejected from the jet nozzles can be reliably and efficiently sucked and discharged by diluting the gravel or the like with water supplied through the water suction pipe.

According to a seventh aspect of the present invention to achieve the above-mentioned object, there is provided a gravel-or-the-like removing device which includes an impeller casing which accommodates an impeller driven by a motor in the inside thereof and has a suction opening at the center of the lower surface, movable rotary digging cutter means which is disposed below the impeller casing and is rotatable about a horizontal axis and is horizontally movable in the direction perpendicular to the horizontal axis, and a peripheral wall for preventing collapse and inflow of gravel or the like which is constituted of a cylindrical body being arranged below the impeller casing and having a cross section in a plan view sufficiently wide to cover the movable rotary digging cutter means from above and makes an upper end thereof contiguously connected to a lower portion of the impeller casing and a lower end thereof reach a position substantially equal to an upper portion of the movable rotary digging cutter means and forms a water retention space therein, and a water suction pipe which has an upper-end opening thereof opened in water above a gravel-or-the-like piled level and a lower-end opening thereof communicably connected to the water retention space.

By providing such a constitution to the gravel-or-the-like removing device, in the same manner as the gravel-or-the-like removing devices according to the first to sixth aspects of the present invention, the inflow of the gravel or the like into the inner space of the peripheral wall for preventing collapse and inflow of gravel or the like can be surely prevented so that the water retention space filled with water can be ensured. Accordingly, by diluting the gravel or the like with water supplied through the water suction pipe, the reliable and efficient suction and discharge of the gravel or the like can be realized. Further, according to this aspect of the present invention, against the collapse of gravel or the like which may occur in a construction work for building an underground continuous wall by horizontally moving the movable rotary digging cutter means while rotating such cutter means, the gravel-or-the-like removing device can ensure the water retention space above the movable rotary digging cutter means so that the construction work for building the underground continuous wall can be smoothly performed.

According to an eighth aspect of the present invention to achieve the above-mentioned object, there is provided a gravel-or-the-like removing device which includes a digging cutter which is rotatably driven by a motor about a vertical axis, a peripheral wall for preventing collapse and inflow of gravel or the like which is constituted of a cylindrical body being arranged above the digging cutter and having a cross section in a plan view sufficiently wide to cover the digging cutter from above and makes an upper end thereof contiguously connected to a lower portion of a motor supporting frame and a lower end thereof reach a position substantially equal to an upper portion of the digging cutter and forms a water retention space therein, a suction pump which is installed outside a water region and has a suction opening thereof communicably connected with the water retention space through a gravel-or-the-like suction pipe, and a water suction pipe which has an upper-end opening thereof opened in water above a gravel-or-the-like piled level and a lower-end opening thereof communicably connected to the water retention space.

By providing such a constitution to the gravel-or-the-like removing device, in the same manner as the gravel-or-the-like removing devices according to the first to seventh aspects of the present invention, the inflow of the gravel or the like into the inner space of the peripheral wall for preventing collapse and inflow of gravel or the like can be surely prevented so that the water retention space filled with water can be ensured. Accordingly, by diluting the gravel or the like with water supplied through the water suction pipe, the reliable and efficient suction and discharge of the gravel or the like can be realized. Further, by arranging the heavy suction pump outside the water region, a portion of the gravel-or-the-like removing device which is installed on the water bottom is substantially constituted of the digging cutter, the motor for driving the digging cutter and the peripheral wall for preventing collapse and inflow of gravel or the like. Accordingly, the portion of the gravel-or-the-like removing device which is installed on the water bottom can be light-weighted so that the portion can be easily moved using a ladder beam mounted on a ship or a ground.

According to a ninth aspect of the present invention to achieve the above-mentioned object, there is provided a gravel-or-the-like removing device which includes a suction pump having an impeller casing which accommodates an impeller driven by a motor in the inside thereof and has a suction opening at the center of the lower surface, a cover for preventing collapse and inflow of gravel or the like which is mounted on the suction pump and forms a water retention space which is communicated with the suction opening of the impeller casing at least below the suction opening of the impeller casing, and a water suction pipe which has an upper-end opening thereof opened in water above a gravel-or-the-like piled level and a lower-end opening thereof communicably connected with the water retention space.

By providing such a constitution to the gravel-or-the-like removing device, even when the gravel-or-the-like removing device is not provided with the cylindrical strainer, in the same manner as the first to seventh aspects of the present invention, the inflow of the gravel or the like into the inside of the water retention space can be surely prevented so that the water retention space which is filled with water can be ensured. On the other hand, the water suction pipe is communicably connected to this water retention space. Accordingly, the gravel or the like can be diluted with the water supplied through the underwater suction pipe can be surely and effectively sucked and discharged.

PREFERRED EMBODIMENTS OF THE PRESENT INVENTION

The present invention is specifically explained hereinafter in conjunction with several embodiments shown in attached drawings.

(First Embodiment)

Figure 1:
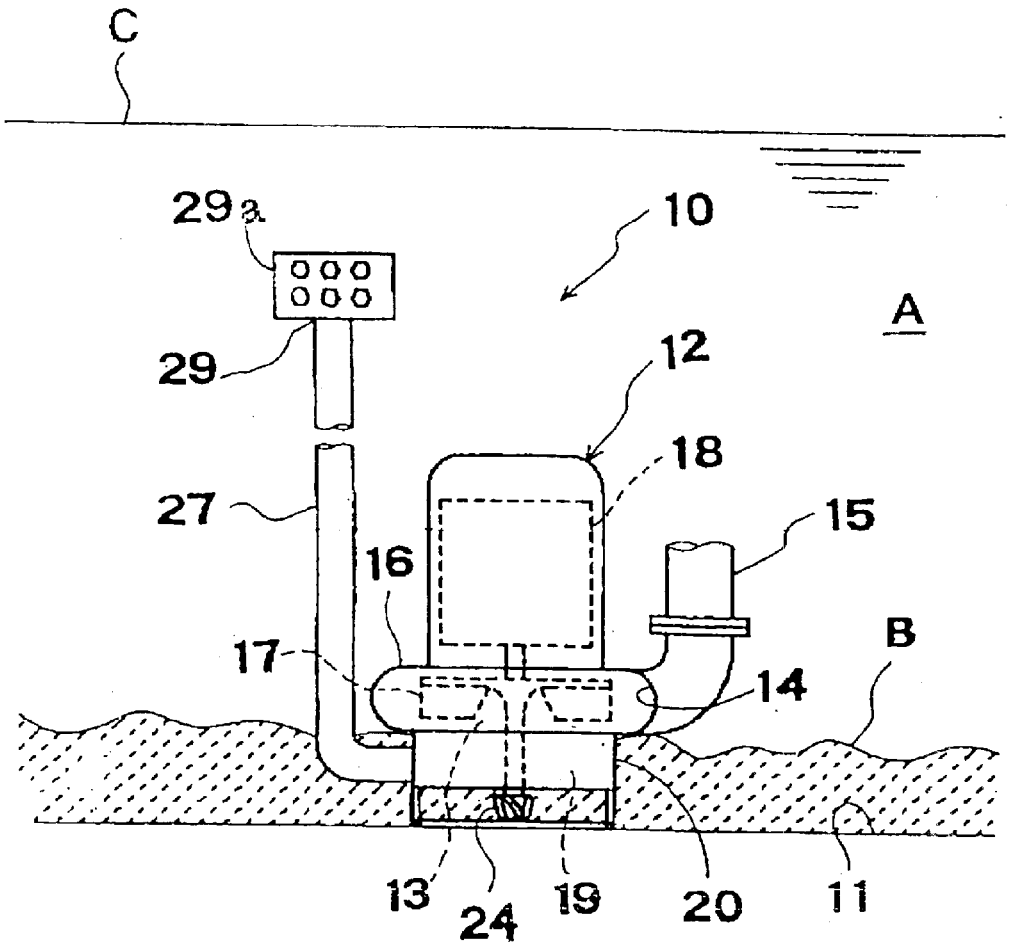
FIG. 1 is an overall front view of a gravel-or-the-like removing device according to the first embodiment of the present invention.
Figure 2:
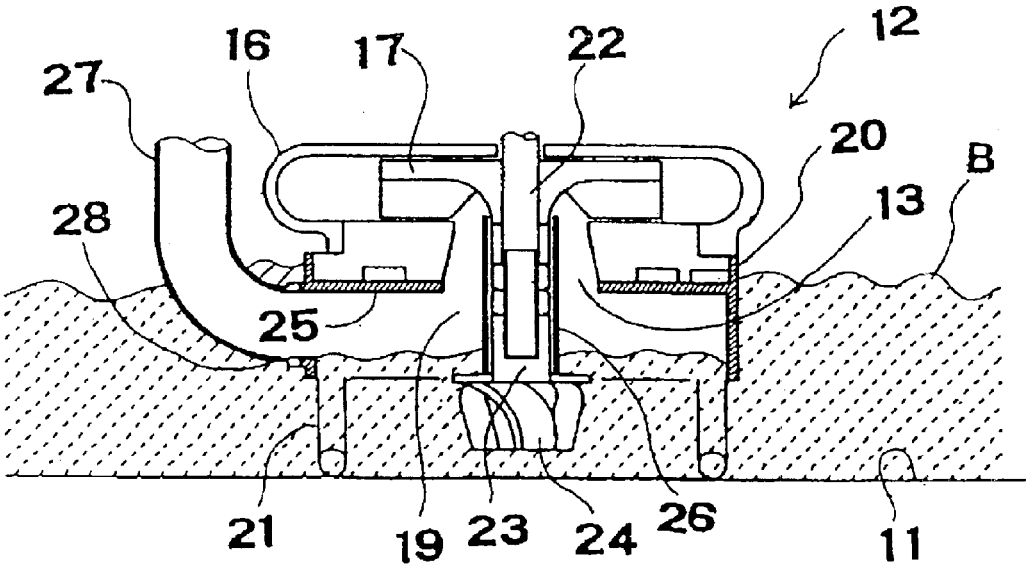
FIG. 2 is an enlarged cross-sectional front view of an essential part of the gravel-or-the-like removing device.

As shown in FIG. 1 and FIG. 2, a gravel-or-the-like removing device 10 according to the first embodiment is installed on a bottom surface 11 of a pit A on which gravel or the like (including mud) is piled. A suction pump 12 which constitutes a body portion of the gravel-or-the-like removing device 10 includes an impeller casing 16 which is provided with a gravel or the like suction opening 13 at the center of a lower end thereof and is provided with a gravel or the like discharge opening 14 at a portion of a peripheral wall thereof which is communicably connected with a discharge pipe 15, an impeller 17 which is rotatably accommodated in the inside of the impeller casing 16, and a watertight motor 18 which rotatably drives the impeller 17.

To a lower portion of the impeller casing 16, an upper end of a cylindrical peripheral wall 20 for preventing collapse and inflow of gravel or the like which is capable of forming a water retention space 19 in the inside thereof and constitutes an essential part of the present invention is contiguously and coaxially connected. In: this embodiment, an outer diameter of the peripheral wall 20 for preventing collapse and inflow of gravel or the like is made slightly smaller than an outer diameter of the impeller casing 16. As shown in the drawings, the peripheral wall 20 for preventing collapse and inflow of gravel or the like is formed of a strip-like plate which has no holes over an entire peripheral surface 20 thereof for performing the gravel-or-the-like collapse and inflow prevention effect which will be explained later. Further, in this embodiment, a lower-end opening of the peripheral wall 20 for preventing collapse and inflow of gravel or the like is fully opened.

The peripheral wall 20 for preventing collapse and inflow of gravel or the like is placed and supported on a pump supporting base 21 which is formed of an annular frame. Further, an agitator 24 is fixedly secured to an agitator mounting shaft 23 which is integrally connected to an output shaft 22 of the watertight motor 18.

Further, in the inside of the peripheral wall 20 for preventing collapse and inflow of gravel or the like, a string winding prevention flat plate 25 is mounted on a lower surface of the impeller casing 16 at the water retention space side and a string winding prevention sleeve 26 is mounted on the agitator mounting shaft 23.

Further, a lower-end opening 28 of a water suction pipe 27 which is vertically disposed in the inside of the pit A is communicably connected with a portion of the peripheral wall 20 for preventing collapse and inflow of gravel or the like, while a water suction auxiliary strainer 29*a* is mounted on arm a upper-end opening 29 of the water suction pipe 27. Here, as shown in FIG. 2, the lower-end opening ?8 of the suction pipe 27 is communicably connected with the peripheral wall 20 for preventing collapse and inflow of gravel or the like at a position below a gravel-or-the-like piled level B, while water suction auxiliary strainer 29*a* is positioned far above the gravel-or-the-like piled level B and in the vicinity of a stored water level C, for example.

Subsequently, the gravel-or-the-like suction and discharge operation performed by the gravel-or-the-like removing device 10 having the above-mentioned constitution is explained in conjunction with FIG. 1 and FIG. 2.

Even when the suction pump 12 is actuated by driving the watertight motor 18 and a negative pressure is generated in the inside of the impeller casing 16, due to the provision of the peripheral wall 20 for preventing collapse and inflow of gravel or the like which has substantially no lateral holes, a phenomenon that a large quantity of gravel or the like present along the outer periphery of the peripheral wall 20 for preventing collapse and inflow of gravel or the like collapses and enters an inner space of the peripheral wall 20 for preventing collapse and inflow of gravel or the like can be surely prevented so that the water retention space 19 filled with water can be ensured.

That is, even when the gravel-or-the-like piled level B is elevated when the operation of the suction pump 12 is stopped or ceased and eventually the impeller casing 16 is embedded in the gravel or the like, the inflow of the gravel or the like into the inner space of the peripheral wall 20 for preventing collapse and inflow of gravel or the like can be surely prevented so that the water retention space 19 filled with water can be ensured. Since this water retention space 19 is communicably connected with the water suction pipe 27, when the suction pump 12 is driven, since the fluidity of water is higher than that of the gravel or the like which enters the lower portion of the suction pump 12, a large quantity of water is supplied by suction and the gravel or the like can be surely and efficiently sucked and discharged by diluting the gravel or the like with this water flow.

Further, according to this embodiment, since the peripheral wall 20 for preventing collapse and inflow of gravel or the like has the lower-end opening thereof fully opened, a perforated bottom plate which constitutes a so-called resistant body is not present. Accordingly, when the suction pump 12 is started and the operation thereof is continued, the gravel or the like can be smoothly and efficiently sucked and discharged while being diluted with water. Depending on the property of the gravel or the like, it may be possible to mount a bottom plate in the lower-end opening of the peripheral wall 20 for preventing collapse and inflow of gravel or the like and to form a plurality of gravel or the like inflow holes in the bottom plate.

Further, in this embodiment, from the viewpoint of completely preventing the collapse and suction of the gravel or the like present along the outer peripheral surface of the peripheral wall 20 for preventing collapse and inflow of gravel or the like into the water retention space 19, the peripheral wall 20 for preventing collapse and inflow of gravel or the like has no holes over the entire peripheral surface thereof. On the other hand, depending on the property of the gravel or the like, to increase the water mixing ratio, the peripheral wall 20 for preventing collapse and inflow of gravel or the like may be partially provided with holes on the condition that the collapse and the inflow of the gravel or the like into the water retention space 19 are not generated.

Further, in this embodiment, the output shaft 22 of the watertight motor 18 is extended downwardly passing through the gravel or the like suction opening 13 of the impeller casing 16 and a central portion; of the peripheral wall 20 for preventing collapse and inflow of gravel or the like and an agitator 24 is fixedly secured to an extended end. Since the gravel or the like can be sucked and discharged by the suction pump 12 after agitating the gravel or the like with this agitator 24, the suction and discharge effect can be further enhanced.

Further, in this embodiment, since a string winding prevention flat plate 25 is mounted on the lower surface of the impeller casing 16 at the water retention space side and a string winding prevention sleeve 26 is mounted on an outer peripheral surface of the agitator mounting shaft 23, even when a string is mixed into the gravel or the like, it becomes possible to prevent the string from being entangled with the lower surface of the impeller casing 16 and the agitator mounting shaft 23 as much as possible whereby the gravel or the like containing the string can be smoothly sucked and discharged.

(Second Embodiment)

Figure 3:
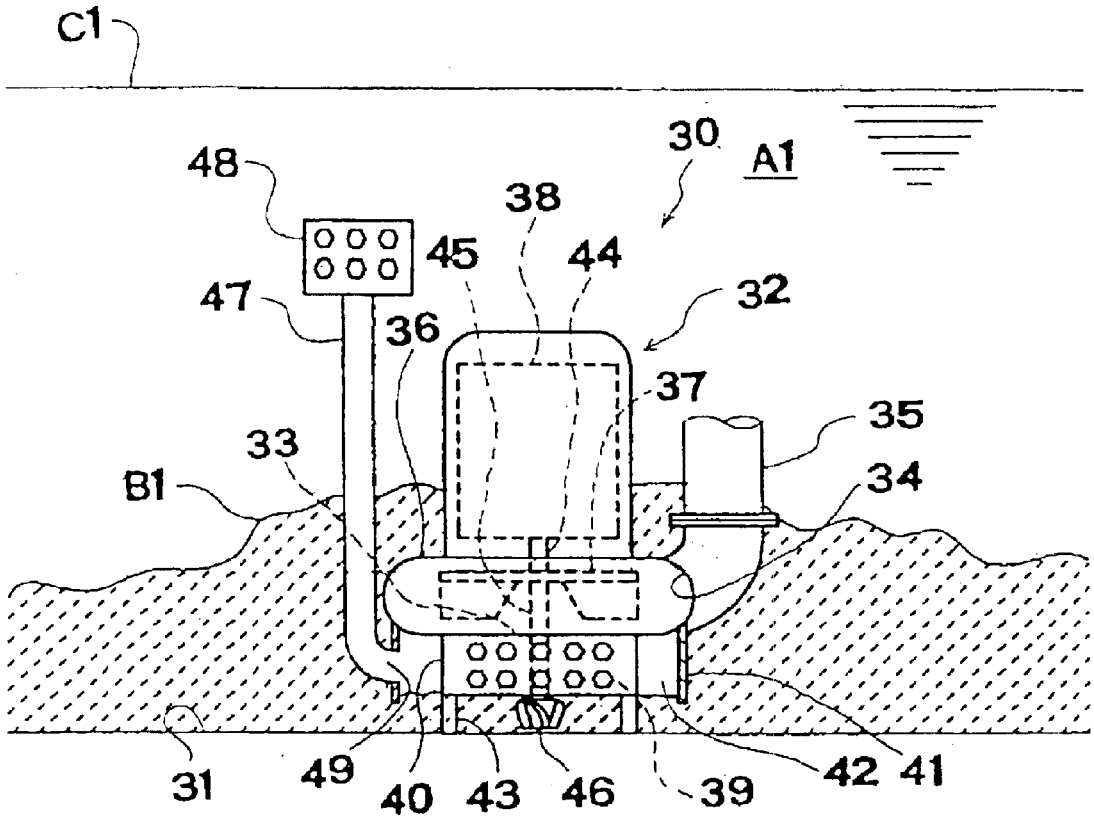
FIG. 3 is an overall front view with a part broken away of a gravel-or-the-like removing device according to the second embodiment of the present invention.

As shown in FIG. 3, a gravel-or-the-like removing device 30 according to the second embodiment is installed on a bottom surface 31 of a pit A1 on which gravel or the like (including mud) is piled. A suction pump 32 which constitutes a body portion of the gravel-or-the-like removing device 30 includes an impeller casing 36 which is provided with a gravel or the like suction opening 33 at the center of a lower end thereof and is provided with a gravel or the like discharge opening 34 at a portion of a peripheral wall thereof which is communicably connected with a discharge pipe 35, an impeller 37 which is rotatably accommodated in the inside of the impeller casing 36, and a watertight motor 38 which rotatably drives the impeller 37.

Below the impeller casing 36, a perforated cylindrical strainer 40 which defines a water retention space 39 in the inside thereof is disposed. The cylindrical strainer 40 has an upper end thereof connected to a bottom portion of the impeller casing 36 and a lower end thereof opened. Further, around the cylindrical strainer 40, a cylindrical peripheral wall 41 for preventing collapse and inflow of gravel or the like which constitutes an essential part of the present invention is concentrically disposed. Between the peripheral wall 41 for preventing collapse and inflow of gravel or the like and the cylindrical strainer 40, an annular water retention space 42 which is communicated with the water retention space 39 in the inside of the cylindrical strainer 40 is defined. In this embodiment, an upper end of the peripheral wall 41 for preventing collapse and inflow of gravel or the like is connected to a lower portion of the impeller casing 16 and a lower end thereof reaches a position substantially equal to a lower end surface of the cylindrical strainer 40. As shown in the drawing, to perform the gravel-or-the-like collapse and inflow prevention effect which will be explained later, the peripheral wall for preventing collapse and inflow of gravel or the like 41 is formed of a strip-like plate having no holes over the entire peripheral surface thereof. Further, in this embodiment, the peripheral wall 41 for preventing collapse and inflow of gravel or the like has the lower-end opening thereof fully opened.

The cylindrical strainer 40 is placed and supported on a pump support base 43 formed of an annular frame. Further, an agitator 46 is fixedly secured to an agitator mounting shaft 45 which is integrally connected an output shaft 44 of the watertight motor 38.

Further, a lower-end opening of a water suction pipe 47 which is vertically disposed in the inside of the pit A1 is communicably connected with a portion of the peripheral wall 41 for preventing collapse and inflow of gravel or the like, while a water suction auxiliary strainer 48 is mounted on an upper-end opening of the water suction pipe 47. Here, as shown in FIG. 3, the lower-end opening 49 of the suction pipe 47 is communicably connected with the peripheral wall 41 for preventing collapse and inflow of gravel or the like at a position below a gravel-or-the-like piled level B1, while the water suction auxiliary strainer 48 is positioned far above the gravel-or-the-like piled level B1 and in the vicinity of a stored water level C1, for example.

Due to the above-mentioned constitution, in the same manner as the gravel-or-the-like removing device 10 according to the first embodiment, the gravel-or-the-like removing device 30 can surely prevent the inflow of the gravel or the like into the inner space of the peripheral wall 41 for preventing collapse and inflow of gravel or the like so that the water retention spaces 39, 42 filled with water can be ensured whereby the gravel or the like can be surely and efficiently sucked and discharged by diluting the gravel or the like with water supplied through the water suction pipe 47.

Further, according to the gravel-or-the-like removing device 30 of this embodiment, by merely mounting the peripheral wall 41 for preventing collapse and inflow of gravel or the like around the cylindrical strainer 40 of an existing gravel-or-the-like removing device (that is, without largely remodeling the existing gravel-or-the-like removing device 30), the above-mentioned reliable and efficient suction and discharge of the gravel or the like can be achieved.

Further, the second embodiment is also characterized in that the above-mentioned gravel-or-the-like removing device 30 also has following constitutions.

That is, also in the second embodiment, in the same manner as the first embodiment, from the viewpoint of completely preventing the collapse and suction of the gravel or the like present along the outer peripheral surface of the peripheral wall 41 for preventing collapse and inflow of gravel or the like into the water retention spaces 39, 42, it is preferable that the peripheral wall for preventing collapse and inflow of gravel or the like 41 has no holes over the entire peripheral surface thereof. On the other hand, depending of the property of the gravel or the like, to increase the water mixing ratio, the peripheral wall 41 for preventing collapse and inflow of gravel or the like may be partially provided with holes on the condition that the collapse and the inflow of the gravel or the like into the water retention spaces 39, 42 are not generated.

Further, also in this embodiment, as shown in FIG. 3, the suction pump 32 can suck and discharge the gravel or the like after enhancing the fluidity of the gravel or the like by agitating the gravel or the like by the agitator 46 and mixing the agitated gravel or the like and water and hence, the gravel or the like suction and discharge effect can be further enhanced.

Figure 4:
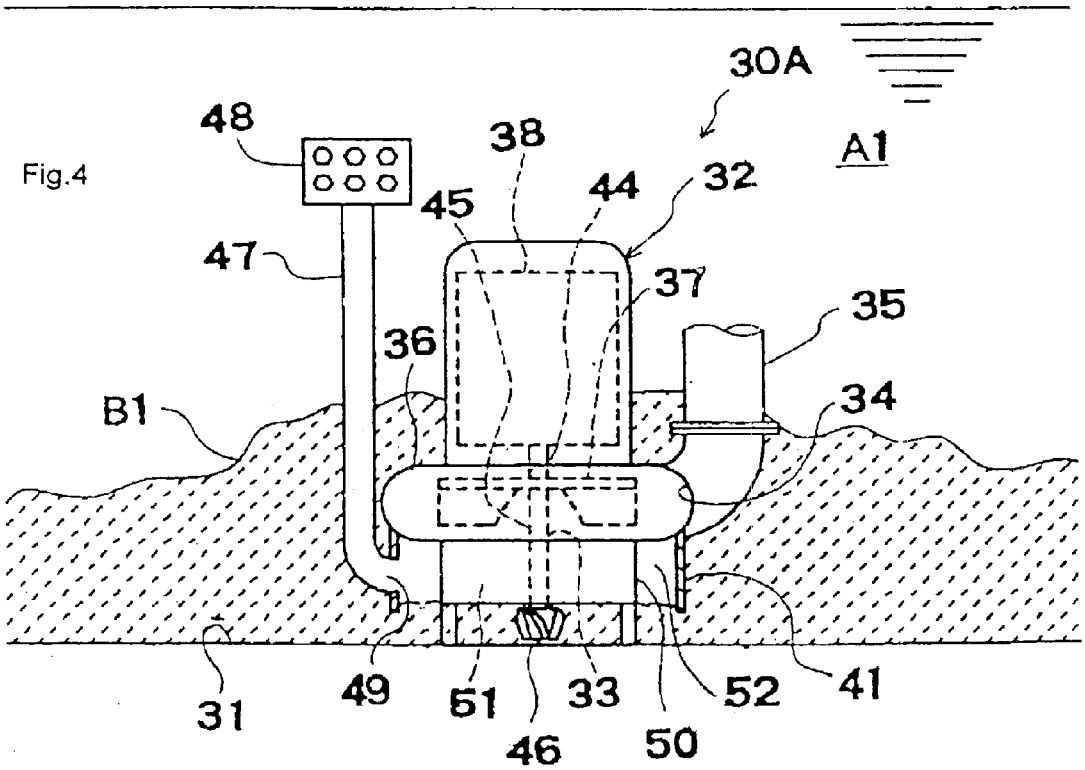
FIG. 4 is an overall front view with a part broken away of a gravel-or-the-like removing device according to a modification of the second embodiment.

Further, as in the case of a gravel-or-the-like removing device 30A according to a modification of this embodiment shown in FIG. 4, a non-perforated peripheral wall 50 having a lower end thereof opened can be used in place of the perforated cylindrical strainer 40 shown in FIG. 3. Here, the water retention space 51 defined in the inside of the non-perforated peripheral wall 50 is communicated with the water retention space 52 which is defined between the non-perforated peripheral wall 50 and the peripheral wall 41 for preventing collapse and inflow of gravel or the like through a lower-end opening of the non-perforated peripheral wall 50. In this case, the non-perforated peripheral wall 50 also functions in the same manner as the peripheral wall 41 for preventing collapse and inflow of gravel or the like so that the inflow of the gravel or the like into the non-perforated peripheral wall 50 can be surely prevented whereby the water retention space 51 can be surely defined in the inside of the non-perforated peripheral wall 50 and the suction and the discharge of the gravel or the like can be surely performed. In modifications 30A–30D according to this embodiment including above-mentioned modification, constitutional elements which are identical with constitutional elements of the embodiment shown in FIG. 3 are indicated by same numerals.

Further, in the embodiment shown in FIG. 3 and the modification shown in FIG. 4, the communicable communication of the lower-end opening of the water suction pipe 47 with the water retention space 42 is performed by communicably connecting a lower-end opening of the suction pipe 47 with a water suction opening 49 formed in the peripheral wall 41 for preventing collapse and inflow of gravel or the like.

Figure 5:
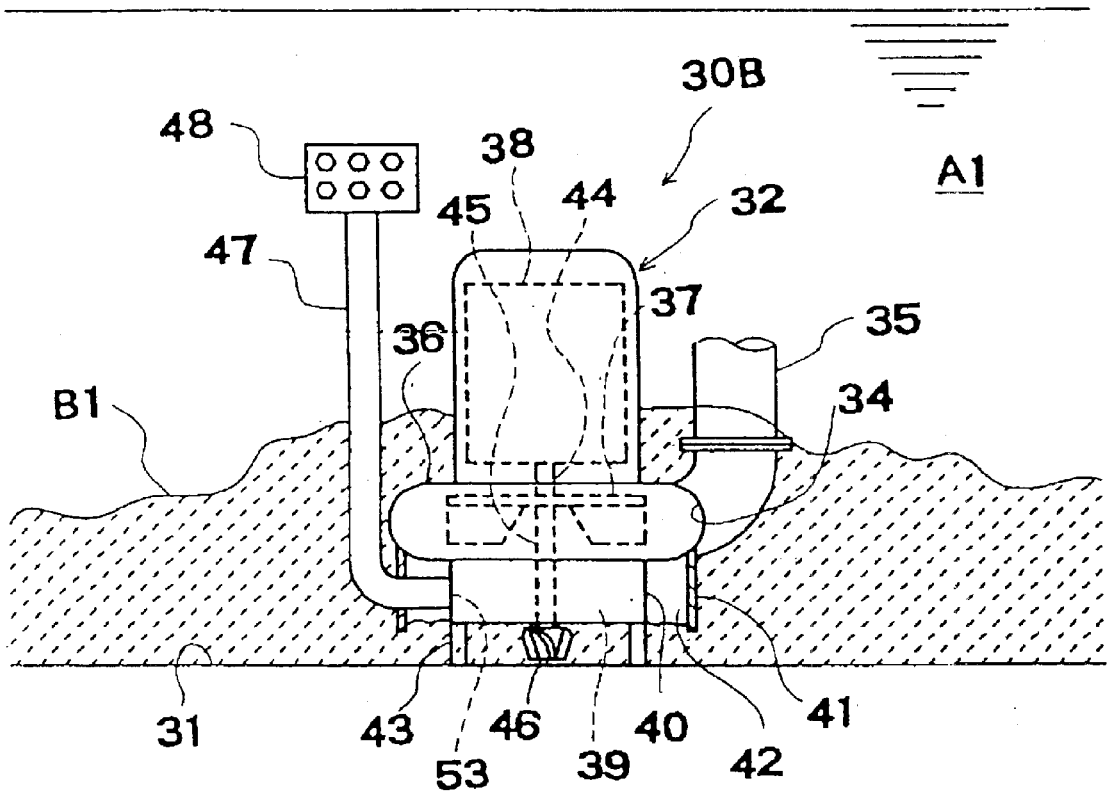
FIG. 5 is an overall front view with a part broken away of a gravel-or-the-like removing device according to a modification of the second embodiment.

However, as in the case of a gravel-or-the-like removing device 30B shown in FIG. 5 which constitutes another modification of this embodiment, the lower-end opening of the water suction pipe 47 is made to penetrate the peripheral wall 41 for preventing collapse and inflow of gravel or the like and thereafter is made to be communicably connected with a water suction opening 53 formed in the cylindrical strainer 40. In this case, since the lower-end opening of the water suction pipe 47 can be directly communicably connected with the water retention space 39 in the inside of the cylindrical strainer 40, even when the gravel or the like flows into the inside of the water retention space 42 which is defined between the cylindrical strainer 40 and the peripheral wall 41 for preventing collapse and inflow of gravel or the like by a chance, so long as the water retention space 39 is ensured in the inside of the cylindrical strainer 40, the suction and the discharge of the gravel or the like can be surely and efficiently performed.

Figure 6:
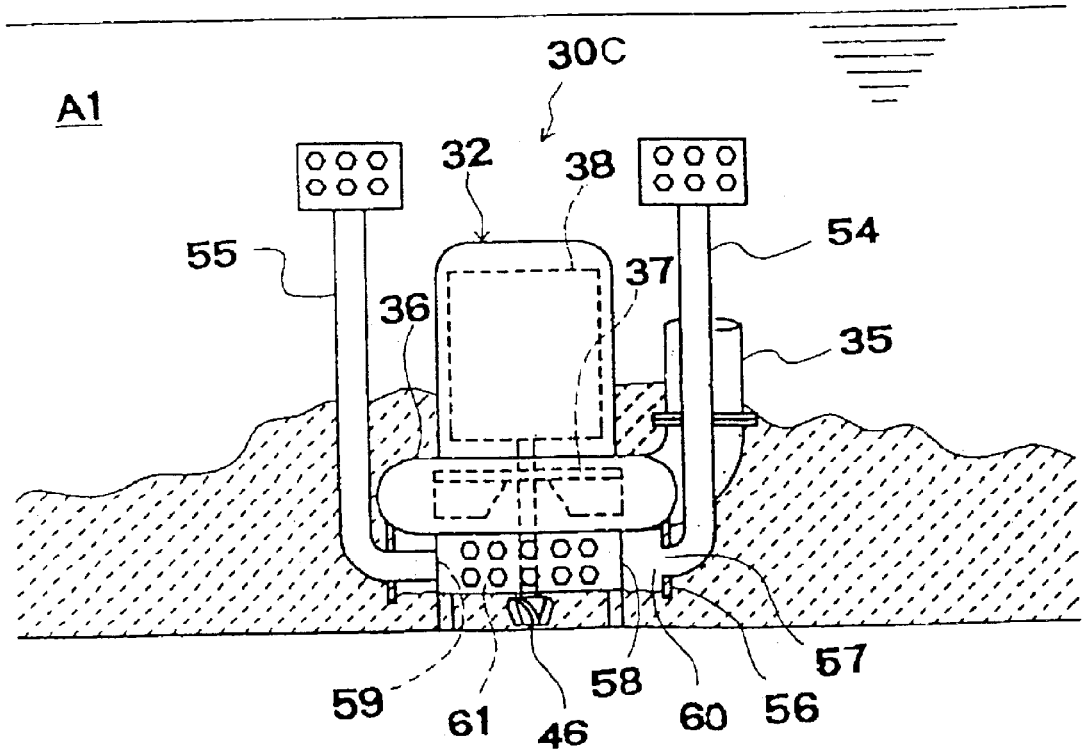
FIG. 6 is an overall front view with a part broken away of a gravel-or-the-like removing device according to a modification of the second embodiment.

Further, a gravel-or-the-like removing device 30C according to another modification of this embodiment is shown in FIG. 6.

As shown in the drawing, in this modification, the gravel-or-the-like removing device 30C is provided with a plurality of (two in this modification) water suction pipes 54, 55. The lower-end opening of one water suction pipe 54 is communicably connected with a water suction opening 57 formed in a peripheral wall 56 for preventing collapse and inflow of gravel or the like and a lower-end opening of the other water suction pipe 55 is made to penetrate the peripheral wall 56 for preventing collapse and inflow of gravel or the like and thereafter is communicably connected with a water suction opening 59 formed in the cylindrical strainer 58. In this case, since water can be supplied to both of a water retention space 60 defined between the cylindrical strainer 58 and the peripheral wall 56 for preventing collapse and inflow of gravel or the like and a water retention space 61 defined in the inside of the cylindrical strainer 58, the gravel or the like can be diluted with water more reliably so that the suction and discharge of the gravel or the like can be performed more reliably and efficiently.

Figure 7:
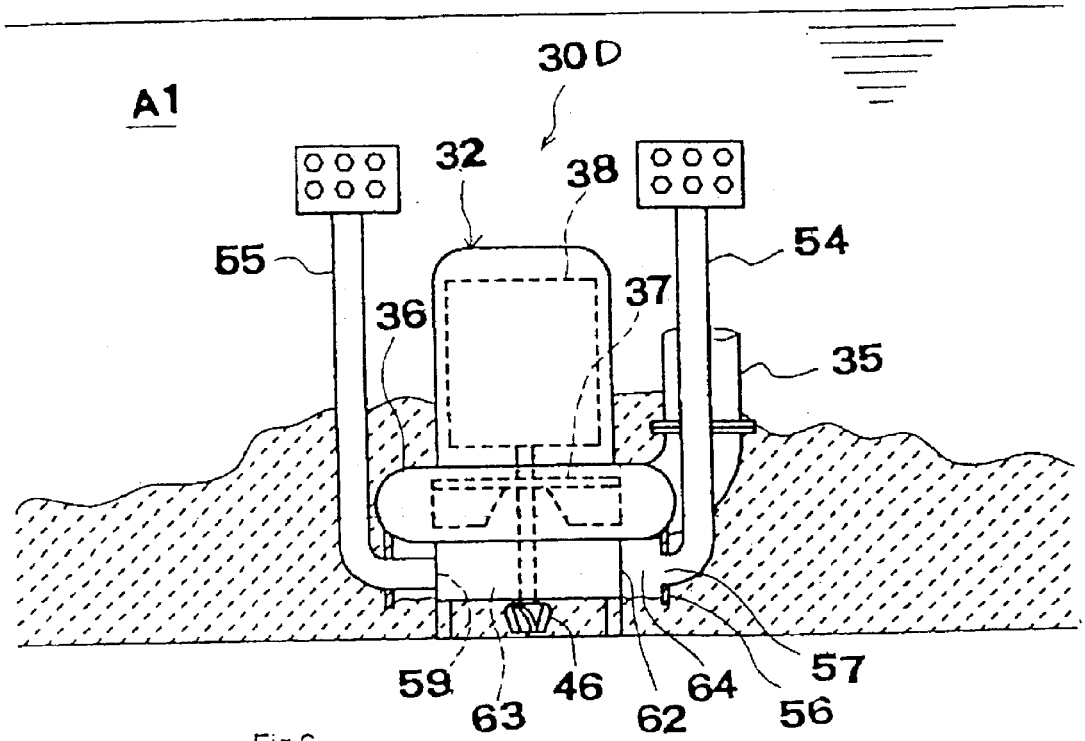
FIG. 7 is an overall front view with a part broken away of a gravel-or-the-like removing device according to a modification of the second embodiment.

Further, a gravel-or-the-like removing device 30D according to another modification of this embodiment shown in FIG. 7 is characterized by using a non-perforated peripheral wall 62 which has only a lower end thereof opened in place of a perforated cylindrical strainer shown in FIG. 6. Here, a water retention space 63 defined in the non-perforated peripheral wall 62 is communicably connected with a water retention space 64 defined between the non-perforated peripheral wall 62 and the peripheral wall 56 for preventing collapse and inflow of gravel or the like through the lower-end opening. Here, since the non-perforated peripheral wall 62 functions in the same manner as the peripheral wall 56 for preventing collapse and inflow of gravel or the like, the inflow of the gravel or the like into the inside of the non-perforated peripheral wall 62 can be surely prevented whereby the water retention space 63 can be surely formed in the inside of the non-perforated peripheral wall 62 and hence, the suction and the discharge of the gravel or the like can be surely performed.

(Third Embodiment)

Figure 8:
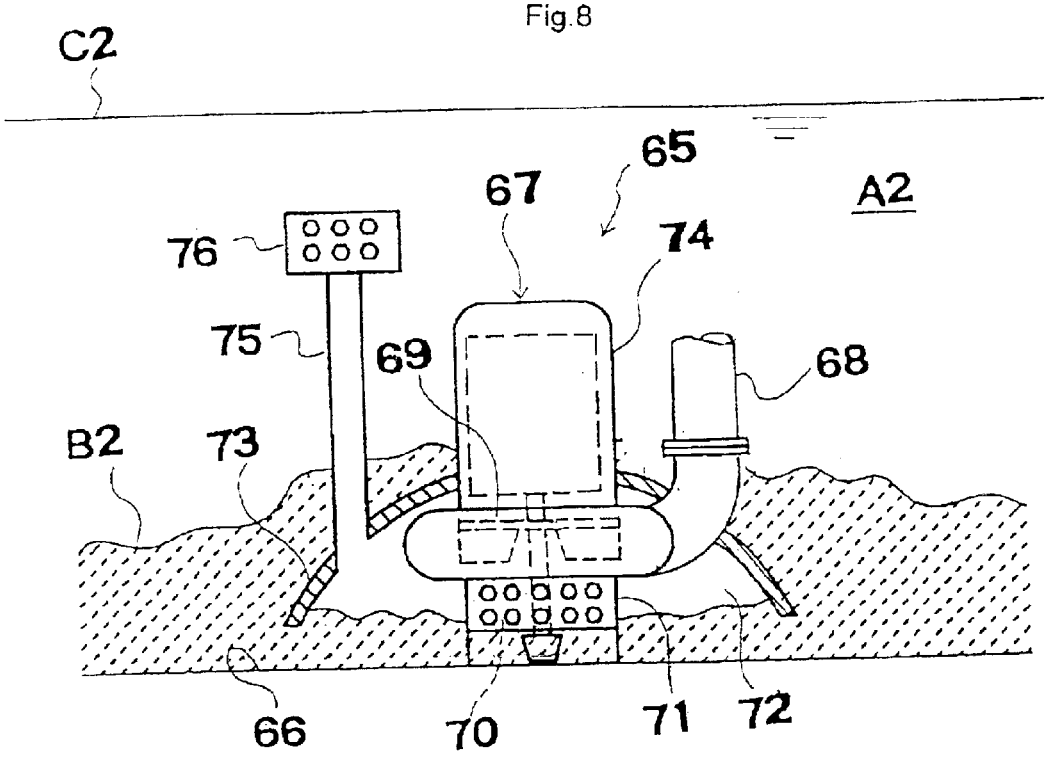
FIG. 8 is an overall front view with a part broken away of a gravel-or-the-like removing device according to the third embodiment of the present invention.

As shown in FIG. 8, a gravel-or-the-like removing device 65 according to the third embodiment is installed on a bottom surface 66 of a pit A2 on which gravel or the like (including mud) is piled. A suction pump 67 which constitutes a body portion of the gravel-or-the-like removing device 65 includes an impeller casing 69 which is provided with a gravel or the like suction opening 67*a* at the center of a lower end thereof and is provided with a gravel or the like discharge opening at a portion of a peripheral wall thereof which is communicably connected with a discharge pipe 68, an impeller 69*a* which is rotatably accommodated in the inside of the impeller casing 69, and a watertight motor 69*b* which rotatably drives the impeller 69*a*.

Below the impeller casing 69, a perforated cylindrical strainer 71 which defines a water retention space 70 in the inside thereof is disposed. The cylindrical strainer 71 has an upper end thereof connected to a bottom portion of the impeller casing 69 and a lower end thereof opened. Further, around the impeller casing 69 and the cylindrical strainer 71, a cover 73 for preventing collapse and inflow of gravel or the like which is preferably non-perforated and defines a water retention space 72 which is communicated with a water retention space 70 defined in the cylindrical strainer 71 is disposed in the inside thereof. The cover 73 for preventing collapse and inflow of gravel or the like is constituted of a bowl-shaped body which opens downwardly, wherein the upper end of the bowl-shaped body is contiguously connected to a motor casing 74 mounted on the impeller casing 69 and the lower end of the bowl-shaped body reaches a position approximately equal to a lower end surface of the cylindrical strainer 71.

Further, a lower-end opening of a water suction pipe 75 which is vertically disposed in the inside of the pit A2 is communicably connected with a portion of the cover for preventing collapse and inflow of gravel or the like 73, while a water suction auxiliary strainer 76 is mounted on an upper-end opening of the water suction pipe 75. Here, as shown in FIG. 8, the lower-end opening of the suction pipe 75 is communicably connected with the cover 73 for preventing collapse and inflow of gravel or the like at a position below a gravel-or-the-like piled level B2, while water suction auxiliary strainer 76 is positioned far above the gravel-or-the-like piled level B2 and in the vicinity of a stored water level C2, for example.

Due to the above-mentioned constitution, in the same manner as the gravel-or-the-like removing devices 10, 30 according to the first and second embodiments, the gravel-or-the-like removing device 65 can surely prevent the inflow of the gravel or the like into the inner space of the cover 73 for preventing collapse and inflow of gravel or the like so that the water retention space 72 filled with water can be ensured whereby the gravel or the like can be surely and efficiently sucked and discharged by diluting the gravel or the like with water supplied through the water suction pipe 75. Further, according to the gravel-or-the-like removing device 65 of this embodiment, since the cover 73 for preventing collapse and inflow of gravel or the like is configured to surround not only the cylindrical strainer 71 but also the impeller casing 69, the wider water retention space can be formed at the lower portion of the gravel-or-the-like removing device 65, whereby the gravel or the like is diluted with water supplied through the water suction pipe 75 thus enabling the more reliable and efficient suction and discharge of the gravel or the like.

(Fourth Embodiment)

Figure 9:
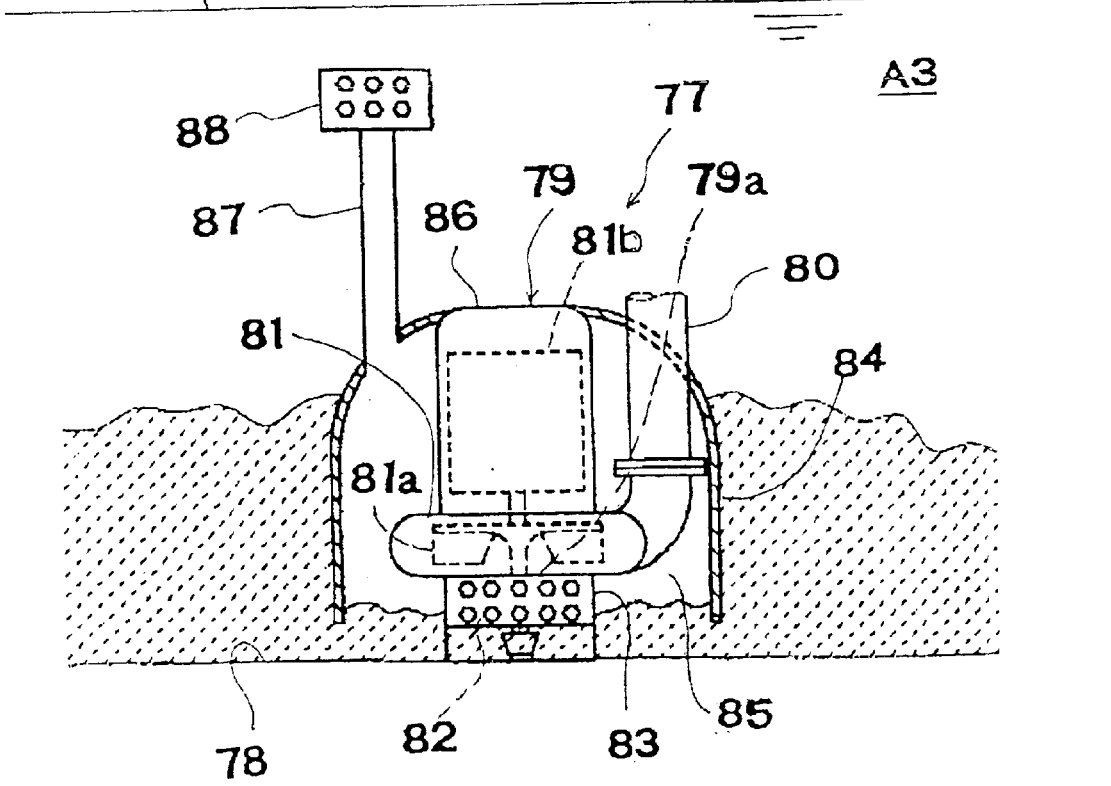
FIG. 9 is an overall front view with a part broken away of a gravel-or-the-like: removing device according to the fourth embodiment of the present invention.

As shown in FIG. 9, a gravel-or-the-like removing device 77 according to the fourth embodiment is installed on a bottom surface 78 of a pit A3 on which gravel or the like (including mud) is piled. A suction pump 79 which constitutes a body portion of the gravel-or-the-like removing device 77 includes an impeller casing 81 which is provided with a gravel or the like suction opening 79*a* at the center of a lower end thereof and is provided with a gravel or the like discharge opening at a portion of a peripheral wall thereof which is communicably connected with a discharge pipe 80, an impeller 81*a* which is rotatably accommodated in the inside of the impeller casing 81, and a watertight motor 81*b* which rotatably drives the impeller 81*a*.

Below the impeller casing 81, a perforated cylindrical strainer 83 which defines a water retention space 82 in the inside thereof is disposed. The cylindrical strainer 83 has an upper end thereof connected to a bottom portion of the impeller casing 81 and a lower end thereof opened. Further, a cover 84 for preventing collapse and inflow of gravel or the like which is preferably non-perforated is disposed in a state that the cover 84 surrounds the whole gravel-or-the-like removing device 77 including the impeller casing 81 and the cylindrical strainer 83. The cover 84 further defines a water retention space 85 which is communicated with a water retention space 82 which is defined in the cylindrical strainer 83 in the inside thereof. The cover 84 for preventing collapse and inflow of gravel or the like is constituted of a bowl-shaped body which opens downwardly, wherein the upper end of the bowl-shaped body is contiguously connected to a top of a motor casing 86 which is mounted on the impeller casing 81 and the lower end of the bowl-shaped body reaches a position approximately equal to a lower end surface of the cylindrical strainer 83.

Further, a lower-end opening of a water suction pipe 87 which is vertically disposed in the inside of the pit A3 is communicably connected with a portion of the cover 84 for preventing collapse and inflow of gravel or the like, while a water suction auxiliary strainer 88 is mounted on an upper-end opening of the water suction pipe 87. Here, as shown in FIG. 9, the lower-end opening of the water suction pipe 87 is communicably connected with the cover 84 for preventing collapse and inflow of gravel or the like at a position below a gravel-or-the-like piled level B3, while the water suction auxiliary strainer 88 is positioned far above the gravel-or-the-like piled level B3 and in the vicinity of a stored water level C3, for example.

Due to the above-mentioned constitution, in the same manner as the gravel-or-the-like removing devices 10, 30, 65 according to the first, second and third embodiments, the gravel-or-the-like removing device 77 can surely prevent the inflow of the gravel or the like into the inner space of the cover 84 for preventing collapse and inflow of gravel or the like so that the water retention spaces 82, 85 filled with water can be ensured whereby the gravel or the like can be surely and efficiently sucked and discharged by diluting the gravel or the like with water supplied through the water suction pipe 87. Further, according to the gravel-or-the-like removing device 77 of this embodiment, since the cover 84 for preventing collapse and inflow of gravel or the like is configured to surround not only the cylindrical strainer 83 but also the whole gravel-or-the-like removing device 77, the further wider water retention space can be formed at the lower portion of the gravel-or-the-like removing device 77, whereby the gravel or the like is diluted with water supplied through the water suction pipe 87 thus enabling the more reliable and efficient suction and discharge of the gravel or the like.

(Fifth Embodiment)

Figure 10:
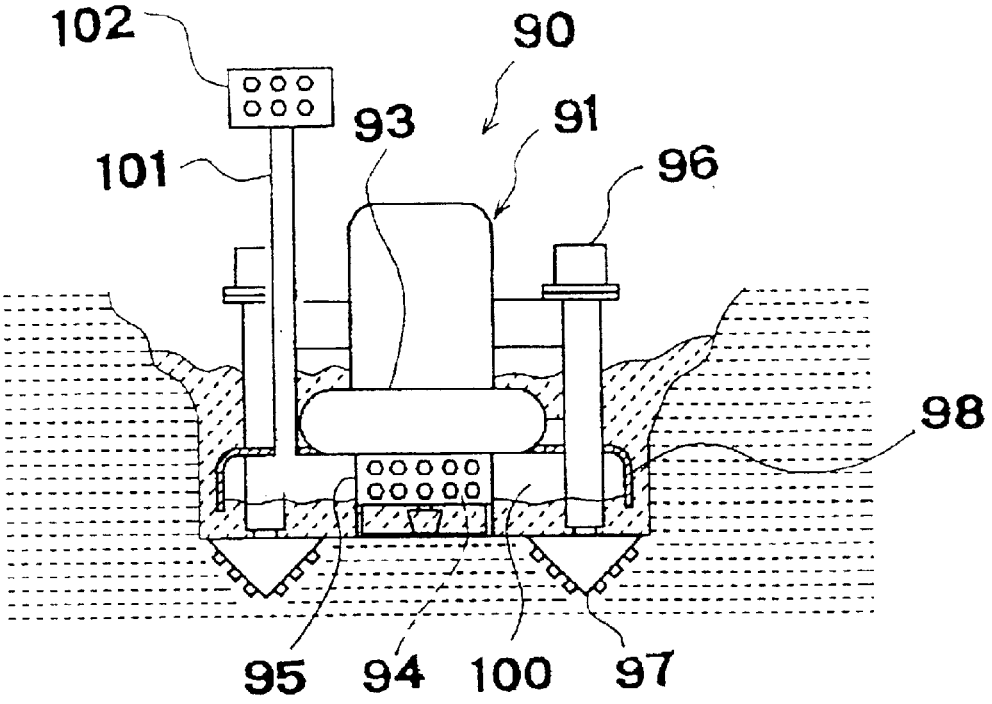
FIG. 10 is an overall front view with a part broken away of a gravel-or-the-like removing device according to the fifth embodiment of the present invention.

As shown in FIG. 10, a gravel-or-the-like removing device 90 according to the fifth embodiment is provided for digging a water bed or a sea bed. A suction pump 91 which constitutes a body portion of the gravel-or-the-like removing device 90 includes an impeller casing 93 which is provided with a gravel-or-the-like suction opening (not shown in the drawing) at the center of a lower end thereof and is provided with a gravel-or-the-like discharge opening at a portion of a peripheral wall thereof which is communicably connected with a discharge pipe (not shown in the drawing), an impeller (not ill shown in the drawing) which is rotatably accommodated in the inside of the impeller casing 93, and a watertight motor (not shown in the drawing) which rotatably drives the impeller.

Below the impeller casing 93, a perforated cylindrical strainer 95 which defines a water retention space 94 in the inside thereof is disposed. The cylindrical strainer 95 has an upper end thereof connected to a bottom portion of the impeller casing 93 and a lower end thereof opened. Further, a plurality of rotary digging cutters 97 which are driven by motors 96 are arranged around the cylindrical strainer 95. Further, a peripheral wall 98 for preventing collapse and inflow of gravel or the like which is preferably non-perforated is disposed around the cylindrical strainer 95. The peripheral wall 98 is constituted of a cylindrical body which has a cross section in a plan view sufficiently wide to cover the rotary digging cutters 97 together with the cylindrical strainer 95 from above and makes an upper end thereof contiguously connected to a lower portion of the impeller casing 93 and a lower end thereof reach a position substantially equal to a lower end surface of the cylindrical strainer 95. The peripheral wall 98 further defines a water retention space 100 which is communicated with the water retention space 94 which is defined in the cylindrical strainer 95.

Further, a lower-end opening of a water suction pipe 101 is communicably connected with a portion of the peripheral wall 98 for preventing collapse and inflow of gravel or the like, while a water suction auxiliary strainer 102 is mounted on an upper-end opening of the water suction pipe 101.

Due to the above-mentioned constitution, in the same manner as the gravel-or-the-like removing devices 10, 30, 65, 77 according to the first, second, third and fourth embodiments, the gravel-or-the-like removing device 90 can surely prevent the inflow of the gravel or the like into the inner space of the peripheral wall 98 for preventing collapse and inflow of gravel or the like so that the water retention space 100 filled with water can be ensured whereby the gravel or the like can be surely and efficiently sucked and discharged by diluting the gravel or the like with water supplied through the water suction pipe 101. Further, according to this embodiment, since the peripheral wall 98 for preventing collapse and inflow of gravel or the like is constituted of a cylindrical body which is arranged around the cylindrical strainer 95 and has a cross section in a plan view sufficiently wide to cover the rotary digging cutters 97 together with the cylindrical strainer 95 from above, the wider water retention space can be formed at the lower portion of the gravel-or-the-like removing device 90 whereby the gravel or the like dug by the rotary digging cutters 97 can be reliably and efficiently sucked and discharged by diluting the gravel or the like with water supplied through the water suction pipe 101. Further, in this embodiment, in the course of digging process, even when the gravel-or-the-like removing device 90 is embedded in the gravel or the like due to the collapse of a wall formed of the dug gravel or the like, it becomes possible to ensure the water retention space 100.

(Sixth Embodiment)

Figure 11:
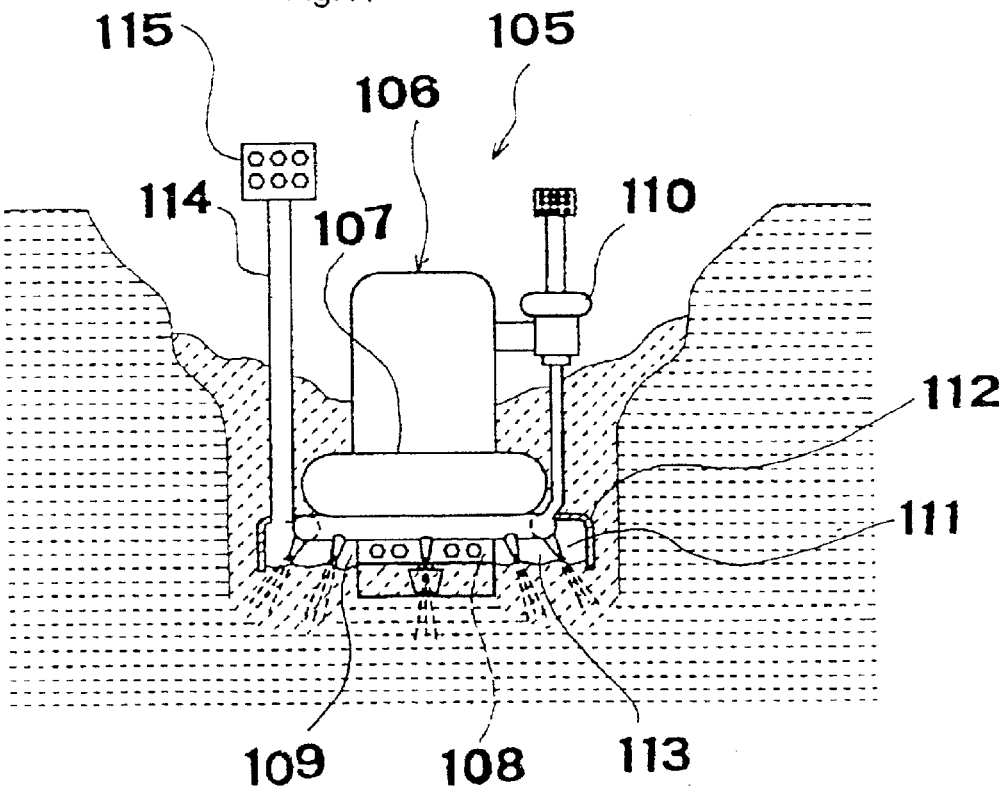
FIG. 11 is an overall front view with a part broken away of a gravel-or-the-like removing device according to the sixth embodiment of the present invention.

As shown in FIG. 11, a gravel-or-the-like removing device 105 according to the sixth embodiment is provided for digging a water bed or a sea bed. A suction pump 106 which constitutes a body portion of the gravel-or-the-like removing device 105 includes an impeller casing 107 which is provided with a gravel or the like suction opening (not shown in the drawing) at the center of a lower end thereof and is provided with a gravel or the like discharge opening at a portion of a peripheral wall thereof which is communicably connected with a discharge pipe (not shown in the drawing), an impeller (not shown in the drawing) which is rotatably accommodated in the inside of the impeller casing 107, and a watertight motor (not shown in the drawing) which rotatably drives the impeller.

Below the impeller casing 107, a perforated cylindrical strainer 109 which defines a water retention space 108 in the inside thereof is disposed. The cylindrical strainer 109 has an upper end thereof connected to a bottom portion of the impeller casing 107 and a lower end thereof opened. Further, a plurality of jet nozzles 111 which eject jet waters downwardly upon actuation of a high-pressure jet water supply pump 110 are arranged around the cylindrical strainer 109 in a circumferentially spaced-apart manner. Further, a peripheral wall 112 for preventing collapse and inflow of gravel or the like which is preferably non-perforated is disposed around the cylindrical strainer 109. The peripheral wall 112 is constituted of a cylindrical body which has a cross section in a plan view sufficiently wide to cover the jet nozzles 111 together with the cylindrical strainer 109 from above and makes an upper end thereof contiguously connected to a lower portion of the impeller casing 107 and a lower end thereof reach a position substantially equal to a lower end surface of the cylindrical strainer 109. The peripheral wall 112 further defines a water retention space 113 which is communicated with a water retention space 108 which is defined in the cylindrical strainer 109 in the inside thereof.

Further, a lower-end opening of a water suction pipe 114 is communicably connected with a portion of the peripheral wall 112 for preventing collapse and flow of gravel or the like, while a water suction auxiliary strainer 115 is mounted on an upper-end opening of the water suction pipe 114.

Due to the above-mentioned constitution, in the same manner as the gravel-or-the-like removing devices 10, 30, 65, 77, 105 according to the first to fifth embodiments, the gravel-or-the-like removing device 90 can surely prevent the inflow of the gravel or the like into the inner space of the peripheral wall 112 for preventing collapse and inflow of gravel or the like so that the water retention spaces 108, 113 filled with water can be ensured whereby the gravel or the like can be surely and efficiently sucked and discharged by diluting the gravel or the like with water supplied through the water suction pipe 114. Further, according to this embodiment, since the peripheral wall 112 for preventing collapse and inflow of gravel or the like is constituted of a cylindrical body which is arranged around the cylindrical strainer 109 and has a cross section in a plan view sufficiently wide to cover the jet nozzles 111 together with the cylindrical strainer 109 from above, the wider water retention space can be formed at the lower portion of the gravel-or-the-like removing device 105 whereby the gravel or the like dug by jet water ejected from the jet nozzles 111 can be reliably and efficiently sucked and discharged by diluting the gravel or the like with water supplied through the water suction pipe 114. Further, in this embodiment, in the course of digging process, even when the gravel-or-the-like removing device 105 is embedded in the gravel or the like due to the collapse of a wall formed of the dug gravel or the like, it becomes possible to ensure the water retention spaces 108, 113.

(Seventh Embodiment)

Figure 12:
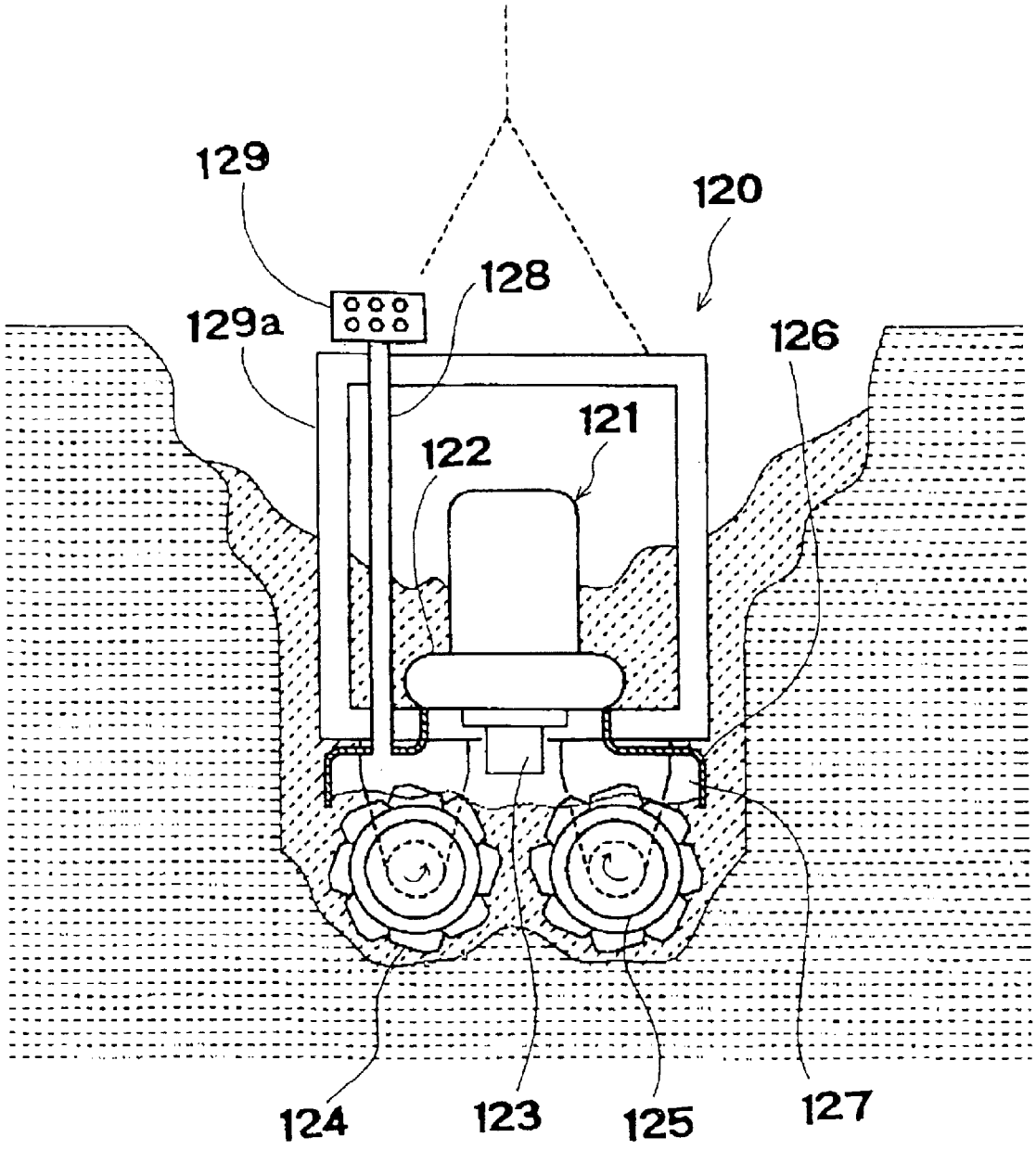
FIG. 12 is an overall front view with a part broken away of a gravel-or-the-like removing device according to the seventh embodiment of the present invention.

As shown in FIG. 12, a gravel-or-the-like removing device 120 according to the seventh embodiment is provided for digging gravel or the like for constructing an underground continuous wall at a civil engineering construction site. A suction pump 121 which constitutes a body portion of the gravel-or-the-like removing device 120 includes an impeller casing 122 which is provided with a gravel or the like suction opening (not shown in the drawing) at the center of a lower end thereof and is provided with a gravel-or-the-like discharge opening at a portion of a peripheral wall thereof which is communicably connected with a discharge pipe (not shown in the drawing), an impeller (not shown in the drawing) which is rotatably accommodated in the inside of the impeller casing 122, and a watertight motor (not shown in the drawing) which rotatably drives the impeller. In the drawing, numeral 123 indicates a suction sleeve which has a lower end thereof opened and is communicably connected with a suction opening for gravel or the like of the impeller casing 122.

Below the impeller casing 122, a pair of movable rotary digging cutters 124, 125 having a structure similar to that of a hob for cutting gears which are arranged in parallel to each other and are rotatable about horizontal axes are disposed. These movable rotary digging cutters 124, 125 have rotating directions which are opposite to each other as shown in arrows. A peripheral wall 126 for preventing collapse and inflow of gravel or the like which is preferably non-perforated is disposed below a lower portion of the impeller casing 122. The peripheral wall 126 is constituted of a cylindrical body which has a cross section in a plan view sufficiently wide to cover a pair of movable rotary digging cutters 124, 125 from above and makes an upper end thereof contiguously connected to a lower portion of the impeller casing 122 and a lower end thereof reach a position substantially equal to upper portions of the movable rotary digging cutters 124, 125. The peripheral wall 126 further defines a water retention space 127 therein.

Further, a lower-end opening of a water suction pipe 128 is communicably connected with a portion of the peripheral wall 126 for preventing collapse and inflow of gravel or the like, while a water suction auxiliary strainer 129 is mounted on an upper-end opening of the water suction pipe 128. The water suction pipe 128 is mounted on a pump suspending frame 129*a* together with the suction pump 121.

Due to the above-mentioned constitution, in the same manner as the gravel-or-the-like removing devices 10, 30, 65, 77, 90, 105 according to the first to sixth embodiments, the gravel-or-the-like removing device 120 can surely prevent the inflow of the gravel or the like into the inner space of the peripheral wall 126 for preventing collapse and inflow of gravel or the like so that the water retention space 127 filled with water can be ensured whereby the gravel or the like can be surely and efficiently sucked and discharged by diluting the gravel or the like with water supplied through the water suction pipe 128. Particularly, in this embodiment, even when the collapse of the gravel or the like is generated in the underground continuous wall construction work in which the movable rotary digging cutters 124, 125 are moved in the horizontal direction while being rotated in the direction indicated by arrows in FIG. 12, it becomes possible to ensure the water retention space 127 above the movable rotary digging cutters 124, 125 and hence, the underground continuous wall construction work can be smoothly carried out.

(Eighth Embodiment)

Figure 13:
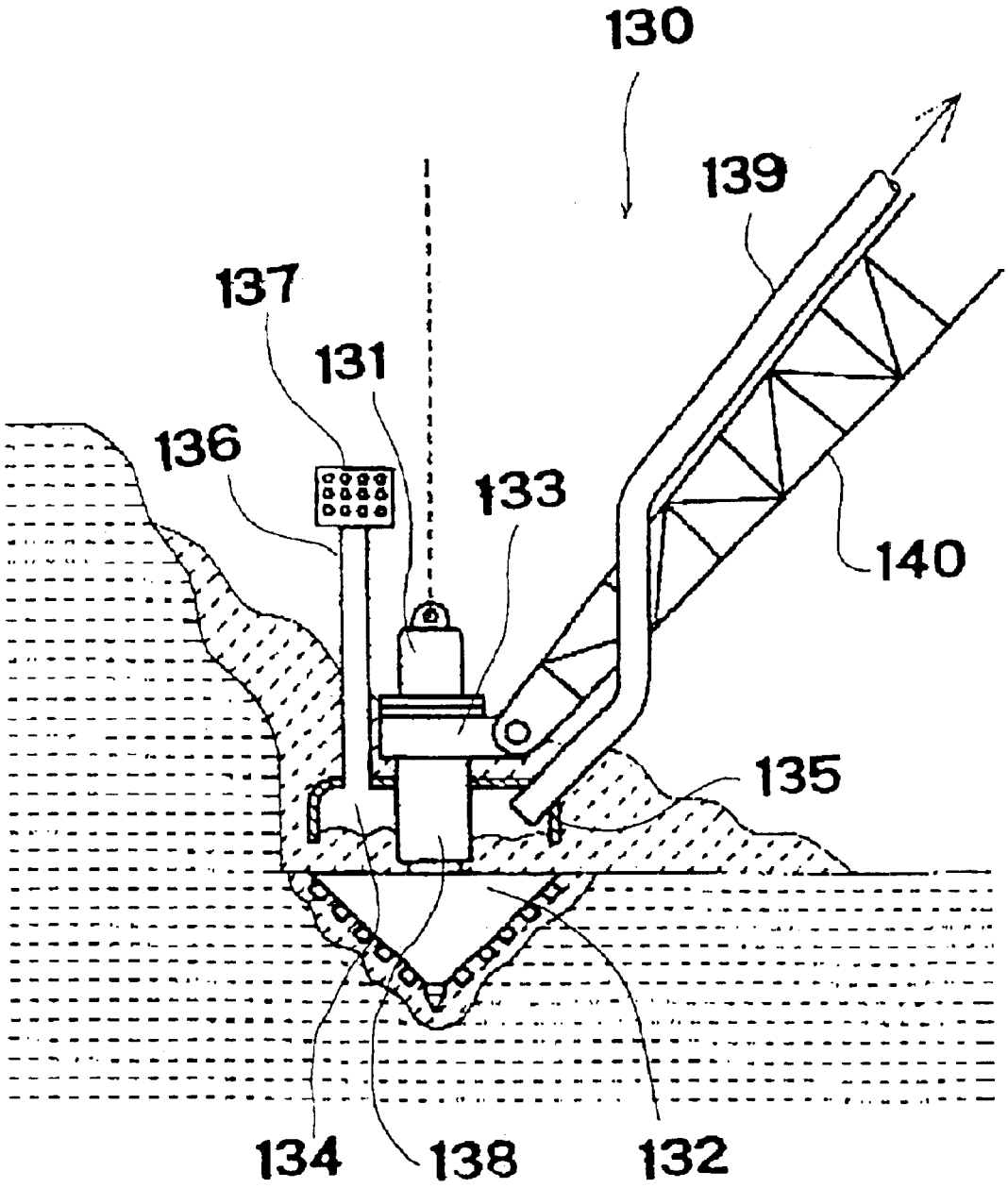
FIG. 13 is an overall front view with a part broken away of a gravel-or-the-like removing device according to the eighth embodiment of the present invention.

As shown in FIG. 13, a gravel-or-the-like removing device 130 according to the eighth embodiment is used for digging a water bed or a sea bed. The gravel-or-the-like removing device 130 is substantially constituted of a digging mechanism portion which is installed underwater and a suction pump (not shown in the drawing) which is installed on a ship or a ground.

As shown in the drawing, the digging mechanism portion includes a digging cutter 132 which is rotatably driven about a vertical axis by a hydraulic motor 131 which constitutes an example of a drive source, and a peripheral wall 135 for preventing collapse and inflow of gravel or the like which is constituted of a cylindrical body being arranged above the digging cutter 132 and having a cross section in a plan view sufficiently wide to cover the digging cutter 132 from above and makes an upper end thereof contiguously connected to a lower portion of a motor supporting frame 133 and a lower end thereof reach a position substantially equal to an upper portion of the digging cutter 132 and forms a water retention space 134 therein.

Further, a lower-end opening of a water suction pipe 136 is communicably connected with a portion of the peripheral wall 135 for preventing collapse and inflow of gravel or the like, while an auxiliary water suction strainer 137 is mounted on an upper-end opening of the water suction pipe 136. The water suction pipe 136 is mounted on a motor support frame 133 together with the hydraulic motor 131. Further, in the drawing, numeral 138 indicates a rotary bearing mechanism portion of the digging cutter 132.

By providing such a constitution to the gravel-or-the-like removing device 130, in the same manner as the gravel-or-the-like removing devices 10, 30, 65, 77, 90, 105, 120 according to the first to seventh aspects of the present invention, the inflow of the gravel or the like into the inner space of the peripheral wall 135 for preventing collapse and inflow of gravel or the like can be surely prevented so that the water retention space filled with water can be ensured. Accordingly, by diluting the gravel or the like with water supplied through the water suction pipe 136, the gravel or the like can be reliably and efficiently sucked and fed to the suction pump installed on the ship or the ground through a suction pipe 139 and thereafter the gravel or the like is discharged into a give location. Further, since a suction pump which constitutes a heavy object is installed outside a water region, a portion of the gravel-or-the-like removing device 130 which is installed on the water bottom and is substantially constituted of the digging cutter, the hydraulic motor 131 for driving the digging cutter 132 and the peripheral wall 135 for preventing collapse and inflow of gravel or the like can be light-weighted so that the portion can be easily moved using a ladder beam 140 mounted on the ship or the ground.

(Ninth Embodiment)

A gravel-or-the-like removing device according to the ninth embodiment, although not shown in the drawing, includes a suction pump having an impeller casing which accommodates an impeller driven by a motor in the inside thereof and has a suction opening at the center of the lower surface, a cover for preventing collapse and inflow of gravel or the like which is mounted on the suction pump and forms a water retention space which is communicable with the suction opening of the impeller casing at least below the suction opening of the impeller casing, and a water suction pipe which has an upper-end opening thereof opened in water above a gravel-or-the-like piled level and a lower-end opening thereof communicably connected with the water retention space. That is, the gravel-or-the-like removing device of this embodiment is characterized by making the cylindrical strainer of the gravel-or-the-like removing device in the second to sixth embodiments unnecessary.

By providing such a constitution to the gravel-or-the-like removing device, even when the gravel-or-the-like removing device is not provided with the cylindrical strainer, in the same manner as the gravel-or-the-like removing device according to the first to sixth aspects of the present invention, it becomes possible to surely prevent the inflow of the gravel or the like into the inner space of the cover for preventing collapse and inflow of gravel or the like so that the water retention space filled with water can be ensured. Accordingly, by diluting the gravel or the like with water supplied through the water suction pipe, the gravel or the like can be reliably and efficiently sucked and discharged.

Figure 14:
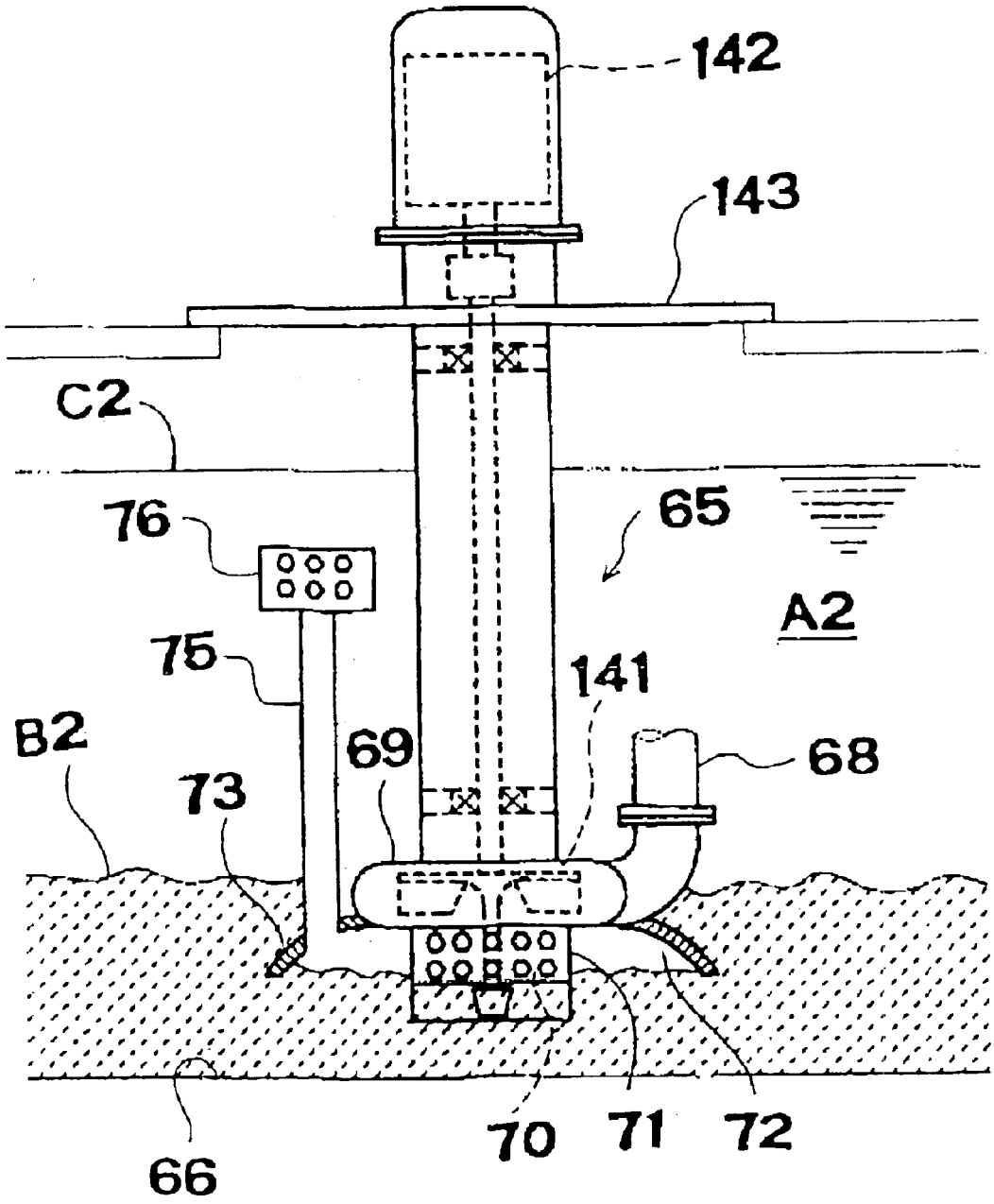
FIG. 14 is an overall front view with a part broken away of a gravel-or-the-like removing device according to a modification of the third embodiment of the present invention.
Figure 15:
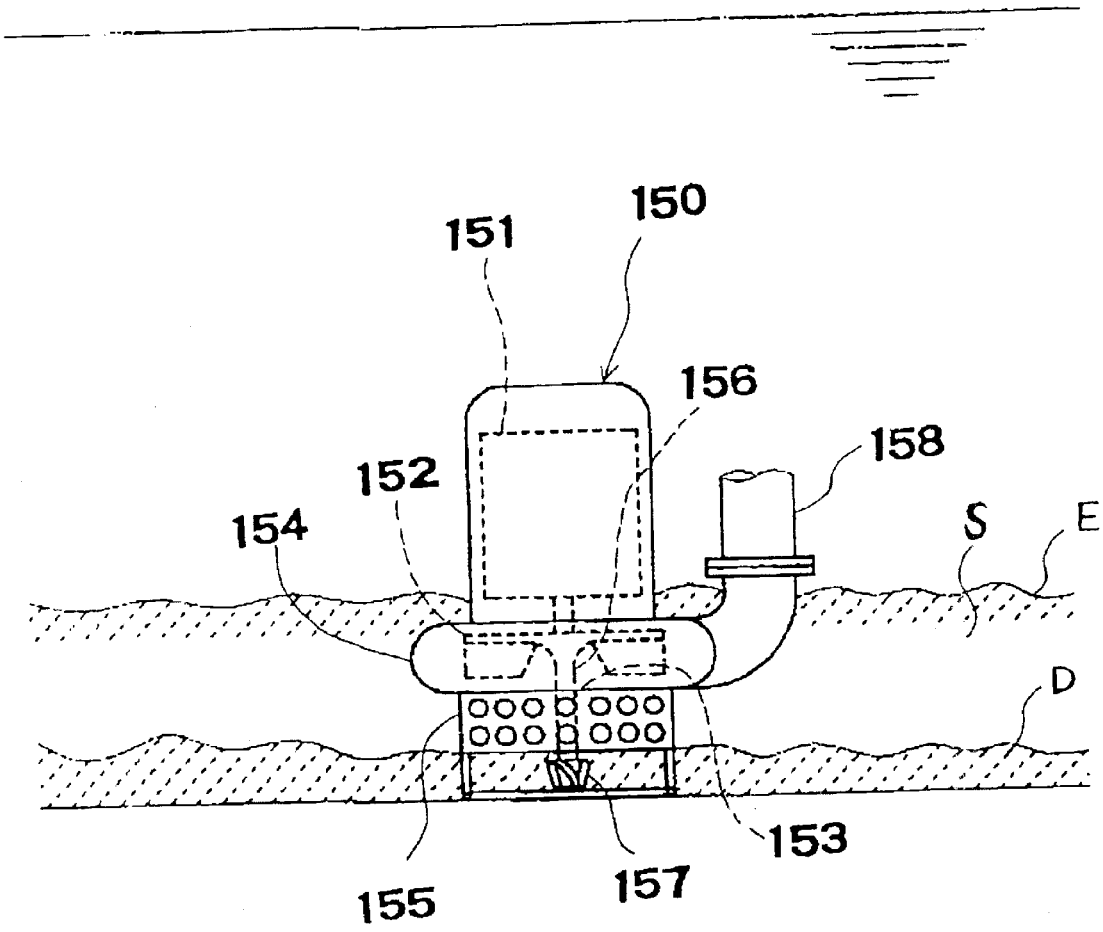
FIG. 15 is an overall front view of a conventional gravel-or-the-like removing device.
Figure 16:
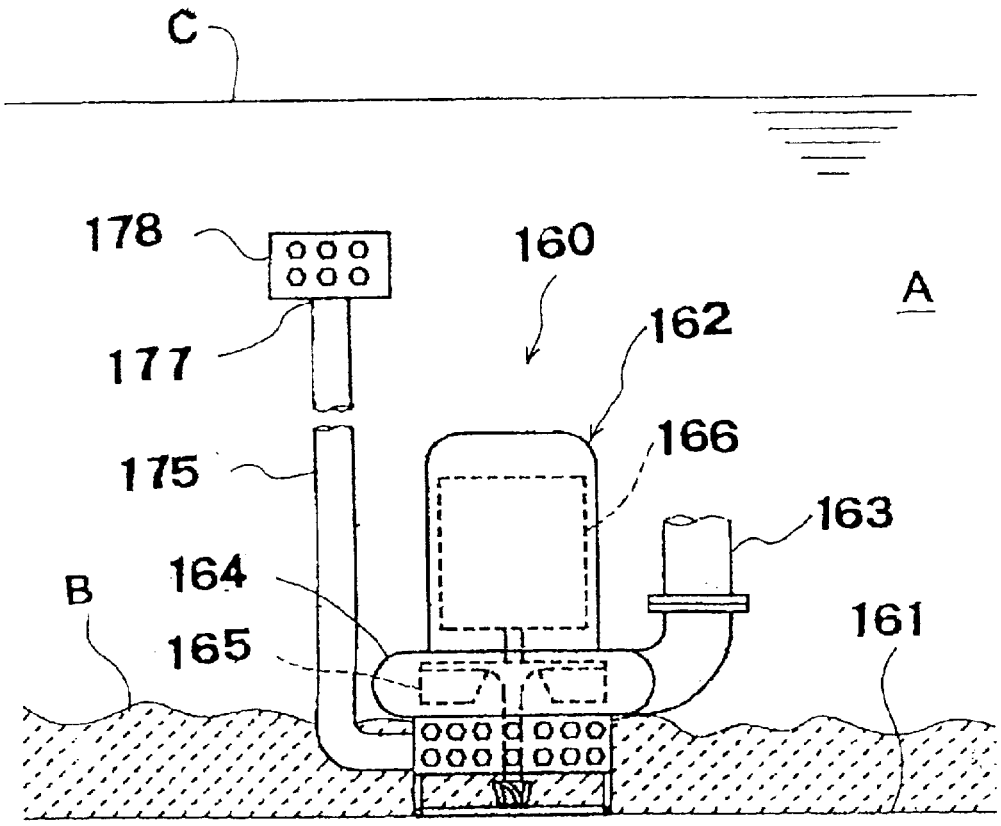
FIG. 16 is an overall front view of another conventional gravel-or-the-like removing device.
Figure 17:
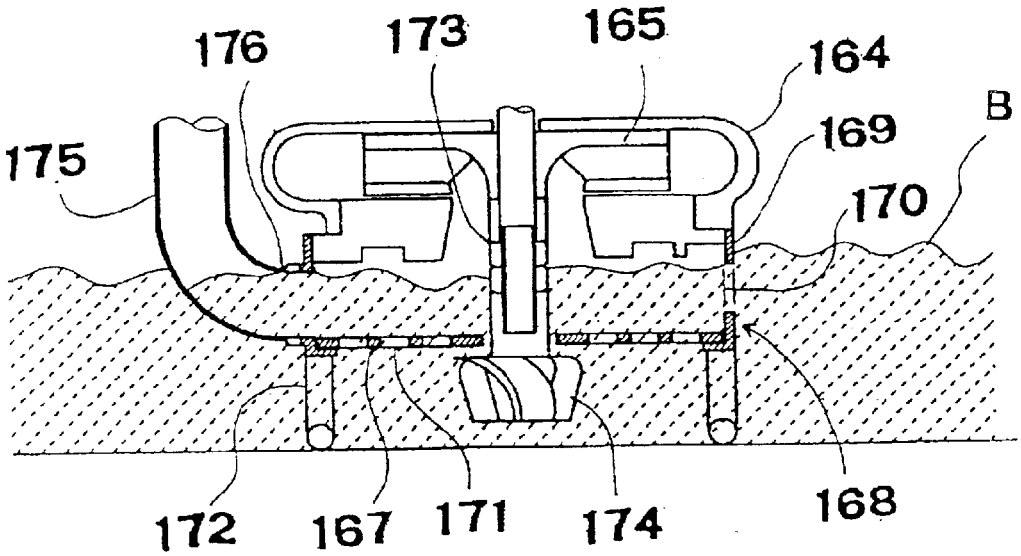
FIG. 17 is an enlarged cross-sectional front view of an essential part of the conventional gravel-or-the-like removing device.

Although the present invention has been explained in conjunction with several embodiments, the present invention is not limited to the above-mentioned embodiments and includes other embodiments without departing from a range of the present invention described in claims. For example, a drive source of the gravel-or-the-like removing device is not limited to the electrically-operated motor and includes a hydraulic motor or the like. Further, in this embodiment, although the gravel-or-the-like removing device is arranged such that the whole gravel-or-the-like removing device is substantially immersed in water, as shown in FIG. 14 which shows a modification of FIG. 8, a motor 142 which drives an impeller 141 may be mounted on a frame 143 which is extended above a water surface. In this case, it is unnecessary to use a watertight motor as a drive source. Further, besides the vertical posture taken in the foregoing embodiments, the gravel-or-the-like removing device may be used in any posture such as the inclined posture depending the condition of use.

What is claimed is:

1. A gravel-like material removing device comprising:

an impeller casing which accommodates an impeller driven by a motor in the inside thereof and has a suction opening at the center of the lower surface, a peripheral wall for preventing collapse and inflow of gravel-like material which is constituted of a cylindrical body which has no holes on an entire peripheral surface thereof and has an upper end thereof connected to a lower portion of the impeller casing and a lower end thereof opened downwardly and forms a water retention space in the inside thereof, and a water suction pipe which has an upper-end opening thereof opened in water above a gravel-like material piled level and a lower-end opening thereof communicably connected with the water retention space.

2. A gravel-like material removing device according to claim 1, wherein an output shaft of the motor is extended downwardly after passing through the suction opening of the impeller casing and the peripheral wall for preventing collapse and inflow of gravel-like material and an agitator is fixedly secured to an extended end of the output shaft.

3. A gravel-like material removing device comprising:

an impeller casing which accommodates an impeller driven by a motor in the inside thereof and has a suction opening at the center of the lower surface, a cylindrical strainer which has an upper end thereof connected to a lower portion of the impeller casing and a lower end thereof opened downwardly, a peripheral wall for preventing collapse and inflow of gravel-like material which is constituted of a cylindrical body arranged around the strainer, makes an upper end of the cylindrical body connected to a lower portion of the impeller casing and a lower end thereof reach a position substantially equal to a lower end surface of the cylindrical strainer and forms a water retention space including the inside of the cylindrical strainer therein, and a water suction pipe which has an upper-end opening thereof opened in water above a gravel-like material piled level and a lower-end opening thereof communicably connected to the water retention space.

4. A gravel-like material removing device according to claim 3, wherein the peripheral wall for preventing collapse and inflow of gravel-like material has no holes on the entire peripheral surface.

5. A gravel-like material removing device according to claim 3, wherein the peripheral wall for preventing collapse and inflow of gravel or the like is partially perforated to an extent that the collapse and inflow of the gravel-like material into the water retention space can be prevented.

6. A gravel-like material removing device according to claim 3, wherein an output shaft of the motor is extended downwardly after passing through the cylindrical strainer and an agitator is fixedly secured to an extended end of the output shaft.

7. A gravel-like material removing device according to claim 3, wherein the communicable communication of the lower-end opening of the water suction pipe to the water retention space is performed by communicably connecting the lower-end opening of the water suction pipe to the water suction opening formed in the peripheral wall for preventing collapse and inflow of gravel or the like.

8. A gravel-like material removing device according to claim 3, wherein the lower-end opening of the water suction pipe penetrates the peripheral wall for preventing collapse and inflow of gravel-like material and thereafter is communicably connected with a water suction opening formed in the cylindrical strainer.

9. A gravel-like material removing device according to claim 3, wherein a plurality of water suction pipes are provided and the lower-end openings of one or more water suction pipes are communicably connected with water suction openings formed in the peripheral wall for preventing collapse and inflow of gravel-like material and the lower-end openings of remaining one or more water suction pipes are made to penetrate the peripheral wall for preventing collapse and inflow of gravel or the like and are communicably connected with the water suction openings formed in the cylindrical strainer.

10. A gravel-like material removing device according to claim 3, wherein the cylindrical strainer is formed of a non-perforated peripheral wall.

11. A gravel-like material removing device comprising:

an impeller casing which accommodates an impeller driven by a motor in the inside thereof and has a suction opening at the center of the lower surface, a cylindrical strainer which has an upper end thereof connected to a lower portion of the impeller casing and a lower end thereof opened downwardly, a cover for preventing collapse and inflow of gravel-like material which is constituted of a bowl-shaped body opened downwardly and arranged around the impeller casing and the cylindrical strainer, makes an upper end of the bowl-shaped body connected to a motor casing which is mounted on the impeller casing and a lower end bowl-shaped body reach a position substantially equal to a lower end surface of the cylindrical strainer and forms a water retention space including the inside of the cylindrical strainer therein, and a water suction pipe which has an upper-end opening thereof opened in water above a gravel-like material piled level and a lower-end opening thereof communicably connected to the water retention space.

12. A gravel-like material removing device comprising:

an impeller casing which accommodates an impeller driven by a motor in the inside thereof and has a suction opening at the center of the lower surface, a cylindrical strainer which has an upper end thereof connected to a lower portion of the impeller casing and a lower end thereof opened downwardly, a cover for preventing collapse and inflow of gravel-like material which is constituted of a bowl-shaped body opened downwardly and arranged to surround the whole gravel-like material removing device including the impeller casing and the strainer and makes a lower end of the bowl-shaped body reach a position substantially equal to a lower end surface of the cylindrical strainer and forms a water retention space including the inside of the cylindrical strainer therein, and a water suction pipe which has an upper-end opening thereof opened in water above a gravel-like material piled level and a lower-end opening thereof communicably connected to the water retention space.

13. A gravel-like material removing device comprising:

an impeller casing which accommodates an impeller driven by a motor in the inside thereof and has a suction opening at the center of the lower surface, a cylindrical strainer which has an upper end thereof connected to a lower portion of the impeller casing and a lower end thereof opened downwardly, a plurality of rotary digging cutters which are driven by motors, a peripheral wall for preventing collapse and inflow of gravel-like material which is constituted of a cylindrical body being arranged around the cylindrical strainer and having across section in a plan view sufficiently wide to cover the rotary digging cutters together with the cylindrical strainer from above and makes an upper end thereof contiguously connected to a lower portion of the impeller casing and a lower end thereof reach a position substantially equal to a lower end surface of the cylindrical strainer and forms a water retention space including the inside of the cylindrical strainer therein, and a water suction pipe which has an upper-end opening thereof opened in water above a gravel-like material piled level and a lower-end opening thereof communicably connected to the water retention space.

14. A gravel-like material removing device comprising:

an impeller casing which accommodates an impeller driven by a motor in the inside thereof and has a suction opening at the center of the lower surface, a cylindrical strainer which has an upper end thereof connected to a lower portion of the impeller casing and a lower end thereof opened downwardly, a plurality of jet nozzles which are arranged around the cylindrical strainer circumferentially and eject jet water downwardly upon actuation of a jet water supply pump, a peripheral wall for preventing collapse and inflow of gravel-like material which is constituted of a cylindrical body being arranged around the cylindrical strainer and having a cross section in a plan view sufficiently wide to cover the jet nozzles together with the cylindrical strainer from above and makes an upper end thereof contiguously connected to a lower portion of the impeller casing and a lower end thereof reach a position substantially equal to a lower end surface of the cylindrical strainer and forms a water retention space including the inside of the cylindrical strainer therein, and a water suction pipe which has an upper-end opening thereof opened in water above a gravel-like material piled level and a lower-end opening thereof communicably connected to the water retention space.

15. A gravel-like material removing device comprising, an impeller casing which accommodates an impeller driven by a motor in the inside thereof and has a suction opening at the center of the lower surface, movable rotary digging cutter means which is disposed below a lower end portion of the impeller casing and is rotatable about a horizontal axis and is horizontally movable in the direction perpendicular to the horizontal axis, a peripheral wall for preventing collapse and inflow of gravel-like material which is constituted of a cylindrical body being arranged below the impeller casing and having a cross section in a plan view sufficiently wide to cover the movable rotary digging cutter means from above and makes an upper end thereof contiguously connected to a lower portion of the impeller casing and a lower end thereof reach a position substantially equal to an upper portion of the movable rotary digging cutter means and forms a water retention space therein, and a water suction pipe which has an upper-end opening thereof opened in water above a gravel-like material piled level and a lower-end opening thereof communicably connected to the water retention space.

16. A gravel-like material removing device comprising:

a digging cutter which is rotatably driven by a motor about a vertical axis, a peripheral wall for preventing collapse and inflow of gravel-like material which is constituted of a cylindrical body being arranged above the digging cutter and having a cross section in a plan view sufficiently wide to cover the digging cutter from above and makes an upper end thereof contiguously connected to a lower portion of a motor supporting frame and a lower end thereof reach a position substantially equal to an upper portion of the digging cutter and forms a water retention space therein, a suction pump installed outside a water region and having a suction opening thereof communicably connected with the water retention space through a gravel-like material suction pipe, and a water suction pipe which has an upper-end opening thereof opened in water above a gravel-like material piled level and a lower-end thereof communicably connected to the water retention space.

17. A gravel-like material removing device comprising:

a suction cup having an impeller casing which accommodates an impeller driven by a motor in the inside thereof and has a suction opening at the center of the lower surface, a cover for preventing collapse and inflow of gravel-like material which is mounted on the suction pump and forms a water retention space which is communicable with the suction opening of the impeller casing at least below the suction opening of the impeller casing, and a water suction pipe which has an upper-end opening thereof opened in water above a gravel-like material piled level and a lower-end opening thereof communicably connected with the water retention space.

* * * * *